US006036381A

United States Patent [19]

Mizukami et al.

[11] Patent Number: 6,036,381

[45] Date of Patent: Mar. 14, 2000

[54] BOOK PRINTER INCLUDING SUPPORT FOR ACCOMMODATING BOUND PORTION

[75] Inventors: Tokio Mizukami, Ayase; Hiroshi Fujikura, Yokohama, both of Japan

[73] Assignee: International Manufacturing & Engineering Service Company, Kanagawa-ken, Japan

[21] Appl. No.: 08/847,465

[22] Filed: Apr. 24, 1997

[30] Foreign Application Priority Data

Apr. 25, 1996 [JP] Japan ..... 8-105551

[51] Int. Cl.[7] ..... B41J 3/28

[52] U.S. Cl. ..... 400/25; 400/27; 400/28

[58] Field of Search ..... 400/24, 25, 27, 400/28

[56] References Cited

U.S. PATENT DOCUMENTS

| | | | |
|---|---|---|---|
| 3,361,243 | 1/1968 | Kaiser | 400/28 |
| 4,143,977 | 3/1979 | Kurihara et al. | 400/24 |

FOREIGN PATENT DOCUMENTS

| | | | |
|---|---|---|---|
| 244879 | 11/1987 | European Pat. Off. . | |
| 62-270354 | 11/1987 | Japan | 400/24 |
| 63-1567 | 1/1988 | Japan | 400/24 |
| 2269371 | 2/1994 | United Kingdom . | |

*Primary Examiner*—Edgar S. Burr
*Assistant Examiner*—Daniel J. Colilla
*Attorney, Agent, or Firm*—F. A. Sirr; E. C. Hancock; Holland & Hart llp

[57] ABSTRACT

A printer prints upon a book having a plurality of pages bound at a binding edge (1). The book is opened, placed on a supporting surface (16) and fed in a feed direction parallel to the binding edge. A supporting shaft (13) extends parallel to the supporting surface. A channel (17) receives the binding edge in the middle of supporting surface and extends perpendicular to the supporting shaft thereby dividing the supporting surface into a first area and a second area. A first supporting frame (14) is pivotally supported on the supporting shaft over the first area. A first rotating shaft (25) is rotatably supported by the first supporting frame parallel with the supporting shaft. A first upper feeding roller (26, 27) is fixed on the first rotating shaft and forced to engage any page placed upon the first area. A second supporting frame (15) is pivotally supported on the supporting shaft over the second area. A second rotating shaft (30) is rotatably supported by the second supporting frame in parallel with the supporting shaft. A second upper feed roller (31,32) is fixed on the second rotating shaft and forced to engage any page placed upon the second area. A universal joint (33) couples the first rotating shaft to the second rotating shaft. A driving means is coupled to one of the first and second rotating shafts.

20 Claims, 10 Drawing Sheets

BOOK PRINTER INCLUDING SUPPORT FOR ACCOMMODATING BOUND PORTION

BACKGROUND OF THE INVENTION

1. Field of the Invention

The present invention relates to printers which print characters on the pages which are exposed when a book is opened, such as a diary, notebook, passbook, passport, loose leaf book, etc. The present invention relates to apparatus and methods for printing on a book which typically has a bound portion by which a plurality of sheets are bound together.

2. Description of the Related Art

A passbook printer has been used which prints directly on the passbook including sheets or pages bound at their edge by feeding the passbook in the direction along the bound portion. In the opened condition, the thickness of the left side pages of the passbook usually differs from the thickness of the right side pages whereas both the thickness are substantially equal when the passbook is opened at a middle page. The terms "left and right pages" used in conjunction with the description of the present invention means the left side portion and the right side portion of the bound portion of the opened passbook. In addition, the thickness of the left side pages, for example, means a total thickness or height of the left side which is determined by the number of stacked sheets of the left side along with the book cover and jacket, if any. Prior art printers for feeding the passbook along the parallel direction to the bound portion have used one of the following two typical feeding mechanisms.

In the first feeding mechanism, one rotating shaft extending, in a perpendicular direction to the direction of the bound portion is mounted above the opened passbook, and one end of the rotating shaft is pivotally supported. The angle between the rotating shaft and the direction of the bound portion is maintained at 90-degrees, and the other end of the pivoted rotating shaft can be moved towards, or away from, the opened passbook. A plurality of feeding rollers made of sponge are fixed on the rotating shaft. In the case wherein the height of both the pages differs from each other, the rotating shaft is inclined, but the rollers are compressed in an effort to maintain engagement with the pages.

In this feeding scheme, however, when the difference of the heights of the left side pages and the right side pages becomes large, the feeding force to the right side pages becomes different from the feeding force to the left side pages. Accordingly, feeding of the passbook in a manner truly parallel to the direction of the bound portion is not performed.

In the second feeding mechanism, one rotating shaft, extending in a perpendicular direction to the direction of the bound portion, is mounted above the opened passbook, and both the ends of the rotating shaft are so supported that both the ends are moved in upward and downward directions, whereby the rotating shaft is moved parallel to the surfaces of both the pages while keeping an angle of 90-degrees to the direction of the bound portion. A plurality of feeding rollers are fixed on the rotating shaft. In this feeding mechanism, however, the rotating shaft is inclined against the left and right pages when the difference of the height of the left side pages and the right side pages becomes large, as in the case of the first mechanism mentioned above. Accordingly, the feeding forces of all the rollers cannot be equal.

SUMMARY OF THE INVENTION

The problem solved by the invention, as stated above, relates to the feeding forces of all the rollers engaging with both the right side pages and left side pages cannot be accommodated in the prior art printer, when the book, such as the passbook, is fed in the opened condition. This problem is solved by the present invention.

More particularly, the opened book is supported on a support surface and fed in a direction generally parallel to the direction established by the bound portion, and the printing of the characters on the pages of both sides of the bound portion is performed in a perpendicular direction to the feed direction. In a printer for printing a book (2) including a plurality of stacked sheets bound at a bound portion (1) in which said book (2) is opened and said opened book (2) is supported on a supporting surface (16) and fed in a feed direction parallel to said bound portion (1), a left side page and a right side page of said book (2) are printed in a direction which is perpendicular to said feed direction.

This printer comprises (a) a supporting shaft (13) supported above said supporting surface (16) and extended in parallel with said supporting surface. It also includes (b) a channel (17) for receiving said bound portion (1), provided in a middle portion of said supporting surface (16) and extended in a direction which is perpendicular to said supporting shaft (13), said supporting surface (16) being divided into first area and second areas by said channel (17). The printer further includes (c) a first supporting frame (14) provided in said first area and pivotally supported on said supporting shaft (13), as well as (d) a first rotating shaft (25) rotatably supported by said first supporting frame (14) in parallel with said supporting shaft (13) and (e) a first upper feeding roller (26, 27) fixed in said first rotating shaft (25), and forced to said page placed on said first area, with (f) a second supporting frame (15) provided in said second area and pivotally supported on said supporting shaft (13).

Still further, the printer has (g) a second rotating shaft (30) rotatably supported by said second supporting frame (15) in parallel with said supporting shaft (13), (h) a second upper feeding roller (31, 32) fixed in said second rotating shaft (30), and forced onto said page placed on said second area, (i) a universal joint (33) coupling said first rotating shaft (25) and said second rotating shaft (30), and (j) a driving means coupled to one of said first rotating shaft (25) and said second rotating shaft (30) for rotating said first and second rotating shafts (25, 30).

In the printer, said driving means includes: a first pulley (28) fixed on said first rotating shaft (25), a second pulley (23) rotatably supported on said supporting shaft (13),and, a first belt (29) for coupling said first pulley (28) and said second pulley (23) for rotating said first pulley (28) and said second pulley (23) in the same direction.

The printer can further comprise a third rotating shaft (34) rotatably mounted below said supporting surface (16) in parallel with said first rotating shaft (25) and said second rotating shaft (30), and rotated by a driving motor (6), a first lower feeding roller (39, 40) and a second lower feeding roller (37, 38) fixed on said third rotating shaft (34), arranged to be opposite to said first upper feeding roller (26, 27) and said second upper feeding roller (31, 32), respectively, and engaging with a bottom of said book. A third pulley (35) is fixed on said third rotating shaft (34), a second belt (36) coupling said third pulley (35) and said second pulley (23) for rotating said third pulley (35) and said second pulley (23) in the same direction, characterized in that a rotating direction of said first upper feeding roller (26, 27) and said second upper feeding roller (31, 32) is opposite to a rotating direction of said first lower feeding roller (39, 40) and said second lower feeding roller (37, 38), and said first and second upper roller (26, 27, 31, 32) and said first and second lower feeding roller (39, 40, 37, 38) apply the same feeding force to said book.

The printer can include a first spring (67) biasing said first rotating shaft (25) and said first upper feeding roller (26, 27) toward said first lower feeding roller (39, 40). A second spring (68) biases said second rotating shaft (30) and said second upper feeding roller (31, 32) to said second lower feeding roller (37, 38). A first member (43) is fixed on said supporting shaft (13) for engaging with said first supporting frame (14) to raise said frame (14), a second member (44) is fixed on said supporting shaft (13) for engaging with said second supporting frame (15) to raise said frame (15), and a rotating means rotates said supporting shaft (13) to raise said first supporting frame (14) and said second supporting frame (15).

The printer can still further include a lever (18) fixed to said supporting shaft (13) and a first driving means (19, 21) for rotating said lever (18) to rotate said supporting shaft (13). In the printer, said first upper feeding roller includes two feeding rollers (26 and 27) for engaging two portions of said page in said first area of said supporting surface (16), and said second upper feeding roller includes two feeding rollers (31 and 32) for engaging two portions of said page in said second area of said supporting surface (16).

The printer further includes a print head (5) moved along a print position (65) adjacent to said first upper feeding roller (26, 27) and said second upper feeding roller (31, 32) in parallel with said supporting shaft (13). In the printer, a movable platen (46) is mounted within a portion of said channel (17), which crosses said print position (65). This platen is moved to a lower position until an upper surface of said platen aligns with a bottom surface of said channel (17) when a printing operation is performed upon said book; and said platen is moved to a top position until said surface of said platen aligns with said supporting surface (16) when a sheet paper is printed.

A printer in accordance with this invention, is primarily intended for printing on a book (2) including a plurality of stacked sheets bound at a bound portion (1) in which said book (2) is opened and said opened book (2) is supported on a supporting surface (16) and fed in a feed direction parallel to said bound portion (1), and a left side page and a right side page of said book (2) are printed in a direction which is perpendicular to said feed direction. This printer comprises (a) a first supporting shaft (13) supported above said supporting surface (16) and extended in parallel relation with said supporting surface, (b) a channel (17) for receiving said bound portion (1) provided in a middle portion of said supporting surface (16) and extended in a direction which is perpendicular to said first supporting shaft (13).

The supporting surface (16) is divided into first and second areas by said channel (17), (c) a first supporting frame (14) is provided in said first area and pivotally supported on said first supporting shaft (13), (d) a first rotating shaft (25) is rotatably supported by said first supporting frame (14) in parallel with said first supporting shaft (13), (e) a first upper feeding roller (26, 27) is fixed on said first rotating shaft (25), and forced toward said page placed on said first area, (f) a second supporting frame (15) is provided in said second area and pivotally supported on said first supporting shaft (13), (g) a second rotating shaft (30) is rotatably supported by said second supporting frame (15) in parallel with said first supporting shaft (13), and (h) a second upper feeding roller (31, 32) is fixed on said second rotating shaft (30), and forced onto said page placed on said second area.

(i) A first universal joint (33) couples said first rotating shaft (25) and said second rotating shaft (30), (j) a second supporting shaft (13A) is supported above said supporting surface (16) and extends in parallel with said supporting surface and said first supporting shaft (13), (k) a third supporting frame (14A) is provided in said first area and pivotally supported on said second supporting shaft (13A), (l) a fourth rotating shaft (25A) is rotatably supported by said third supporting frame (14A) in parallel with said second supporting shaft (13A), and (m) a third upper feeding roller (26A, 27A) is fixed on said fourth rotating shaft (25A), and forced to said page placed on said first area.

(n) A fourth supporting frame (15A) is provided in said second area and pivotally supported on said second supporting shaft (13A), (o) a fifth rotating shaft (30A) is rotatably supported by said fourth supporting frame (15A) in parallel with said second supporting shaft (13A), (p) a fourth upper feeding roller (31A, 32A) is fixed on said fifth rotating shaft (30A), and forced to said page placed on said second area, (q) a second universal joint (33A) couples said fourth rotating shaft (25A) and said fifth rotating shaft (30A), and (r) a driving means rotates said first rotating shaft (25) and said fourth rotating shaft (25A) in the same rotating direction.

This structure is characterized in that said first supporting frame (14) and said third supporting frame (14A) are so arranged that said first upper feeding rollers (26, 27) of said first supporting frame (14) are adjacent to said third upper feeding roller (26A, 27A) of said third supporting frame (14A), and said second supporting frame (15) and said fourth supporting frame (15A) are so arranged that said second upper feeding roller (31, 32) of said second supporting frame (15) are adjacent to said fourth upper feeding roller (31A, 32A) of said fourth supporting frame (15A).

In the printer, said driving means includes a first pulley (28) fixed on said first rotating shaft (25), a second pulley (23) rotatably supported on said first supporting shaft (13), a first belt (29) for coupling said first pulley (28) and said second pulley (23) for rotating said first pulley (28) and said second pulley (23) in the same direction, a fourth pulley (28A) fixed on said fourth rotating shaft (25A), a fifth pulley (23A) rotatably supported on said second supporting shaft (13A), a third belt (29A) for coupling said fourth pulley (28A) and said fifth pulley (23A) for rotating said fourth pulley (28A) and said fifth pulley (23A) in the same direction, and a rotating means (35, 36, 35A, 36A, 72, 76) for rotating said second pulley (23) and said fifth pulley (23A) in the same direction.

The printer can further include a third rotating shaft (34) rotatably mounted below said supporting surface (16) in parallel with said first rotating shaft (25) and said second rotating shaft (30), a first lower feeding roller (39, 40) and a second lower feeding roller (37, 38) fixed on said third rotating shaft (34), arranged to be opposite to said first upper feeding roller (26, 27) and said second upper feeding roller (31, 32), respectively, and engaging with a bottom of said book. A third pulley (35, 70) is fixed on said third rotating shaft (34), a second belt (36) couples said third pulley (35) and said second pulley (23) for rotating said third pulley (35) and said second pulley (23) in the same direction. A sixth rotating shaft (34A) is rotatably mounted below said supporting surface (16) in parallel with said fourth rotating shaft (25A) and said fifth rotating shaft (30A).

A third lower feeding roller (39A, 40A) and a fourth lower feeding roller (37A, 38A) is fixed on said sixth rotating shaft (34A), arranged to be opposite to said third upper feeding roller (26A, 27A) and said fourth upper feeding roller (31A, 32A), respectively, and engaging with a bottom of said book. A sixth pulley (35A, 71) is fixed on said sixth rotating shaft (34A), a fourth belt (36A) couples said sixth pulley (35A, 71) and said fifth pulley (23A) for rotating said sixth pulley (35A, 71) and said fifth pulley (23A) in the same direction, and a rotating means (6, 72, 74) rotates said third pulley (35, 70) and said sixth pulley (35A, 71) in the same direction, characterized in that a rotating direction of said first upper feeding roller (26, 27), said second upper feeding roller (31, 32), said third upper feeding roller (26A, 27*a*) and said fourth upper feeding roller (31A, 21A) is opposite to a rotating direction of said first lower feeding roller (39, 40) and said second lower feeding roller (37, 38). Said third lower feeding roller (39A, 40A) and said fourth lower feeding roller (37A, 38A), as well as all the feeding rollers, apply the same feeding force to said book.

The printer can further comprise a first spring (67) biasing said first rotating shaft (25) and said first upper feeding roller (26, 27) toward said first lower feeding roller (39, 40). A second spring (68) biases said second rotating shaft (30) and said second upper feeding roller (31, 32) toward said second lower feeding roller (37, 38). A first member (43) is fixed on said first supporting shaft (13) for engaging with said first supporting frame (14) to raise said frame (14) while a second member (44) is fixed on said first supporting shaft (13) for engaging with said second supporting frame (15) to raise said frame (15). A third spring (67A) biases said fourth rotating shaft (25A) and said third upper feeding roller (26A, 27A) to said third lower feeding roller (39A, 40A). A fourth spring (68A) biases said fifth rotating shaft (30A) and said fourth upper feeding roller (31A, 32A) to said fourth lower feeding roller (37A, 38A).

A third member (43A) is fixed on said second supporting shaft (13A) for engaging with said third supporting frame (14A) to raise said frame (14A). A fourth member (44A) fixed on said second supporting shaft (13A) engages with said fourth supporting frame (15A) to raise said frame (15A). A first lever (18) is fixed on said first supporting shaft (13), a second lever (18A) is fixed on said second supporting shaft (13A), and a link (73) couples said first lever (18) and said second lever(18A), and is characterized in that when said first upper feeding roller (26, 27) and said second upper feeding roller (31, 32) contact with said first lower feeding roller (39, 40) and said second lower feeding roller (37, 38), respectively, said third upper feeding roller (26A, 27A) and said fourth upper feeding roller (31A, 32A) are separated from said third lower feeding roller (39A, 40A) and said fourth lower feeding roller (37A, 38A), respectively.

In the printer, said first upper feeding roller includes two feeding rollers (26 and 27) for engaging two portions of said page in said first area of said supporting surface (16), and said second upper feeding roller includes two feeding rollers (31 and 32) for engaging two portions of said page in said second area of said supporting surface (16). Said third upper feeding roller includes two feeding rollers (26A and 27A) for engaging two portions of said page in said first area of said supporting surface (16), and said fourth upper feeding roller includes two feeding rollers (31A and 32A) for engaging two portions of said page in said second area of said supporting surface (16).

The printer can incorporate a print head (5) movable along a print position (65) in parallel with said first supporting shaft (13) and said second supporting shaft (13A). A print position (65) is located in an area of said supporting surface (16) between said first and second upper feeding roller (26, 27,31, 32) and said third and fourth upper feeding roller (26A, 27A, 31A, 32A).

In the printer, a movable platen (46) is mounted within a portion of said channel (17), which crosses said print position (65). This platen is moved to a lower position until an upper surface of said platen aligns with a bottom surface of said channel (17) when said book is printed, and said platen is moved to a top position until said surface of said platen aligns with said supporting surface (16) when a sheet paper is printed.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
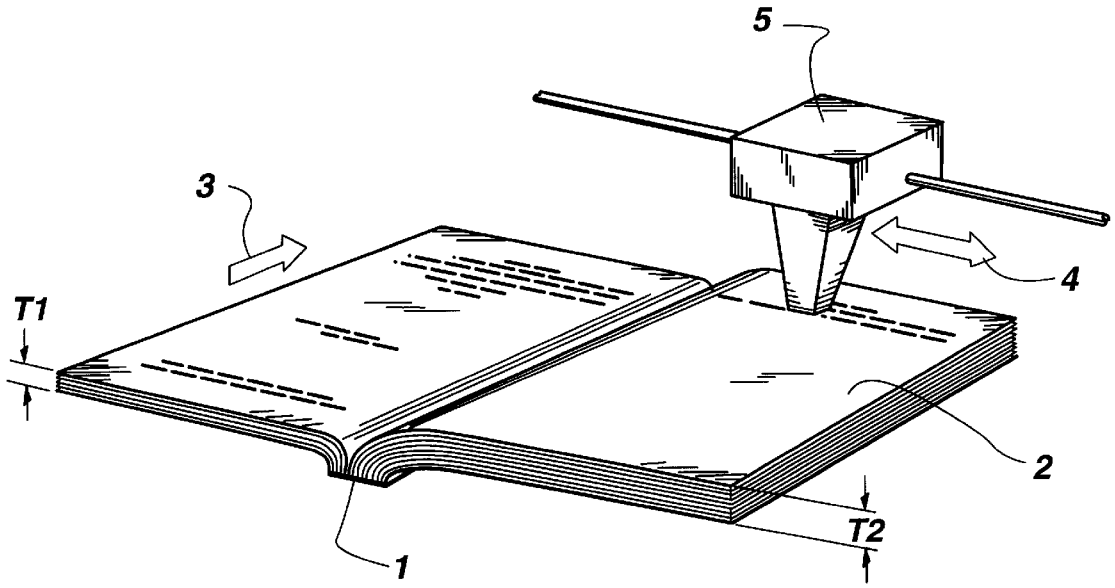
FIG. 1 shows the feeding direction and the printing direction of the book 2.

FIG. 1 shows the printing scheme in accordance with the present invention wherein the book 2 is printed with the condition that the book is opened, and the left side and right side pages of the central bound portion 1 are exposed. Particularly, the printer of the present invention is suitable for printing on a book the bound portion of which is formed by binding the edge by string, staple or paste, and wherein the bound portion is downwardly projected when the book is opened, as shown in the FIG. 1. In the opened condition, the thickness T1 of the left side pages of the book 2 usually differs from the thickness T2 of the right side pages. Both the thickness are substantially equal when the book 2 is opened at a middle page.

The printer in accordance with the present invention can apply a feeding force of the same intensity to the right and left side pages in the direction 3 which is parallel to the direction of the bound portion 1, even if the thickness of the left side pages differs from the thickness of the right side pages (or vice versa), whereby the printer can print the characters on both the right and left pages in the correct direction 4 which is perpendicular to the feeding direction 3.

Figure 2:
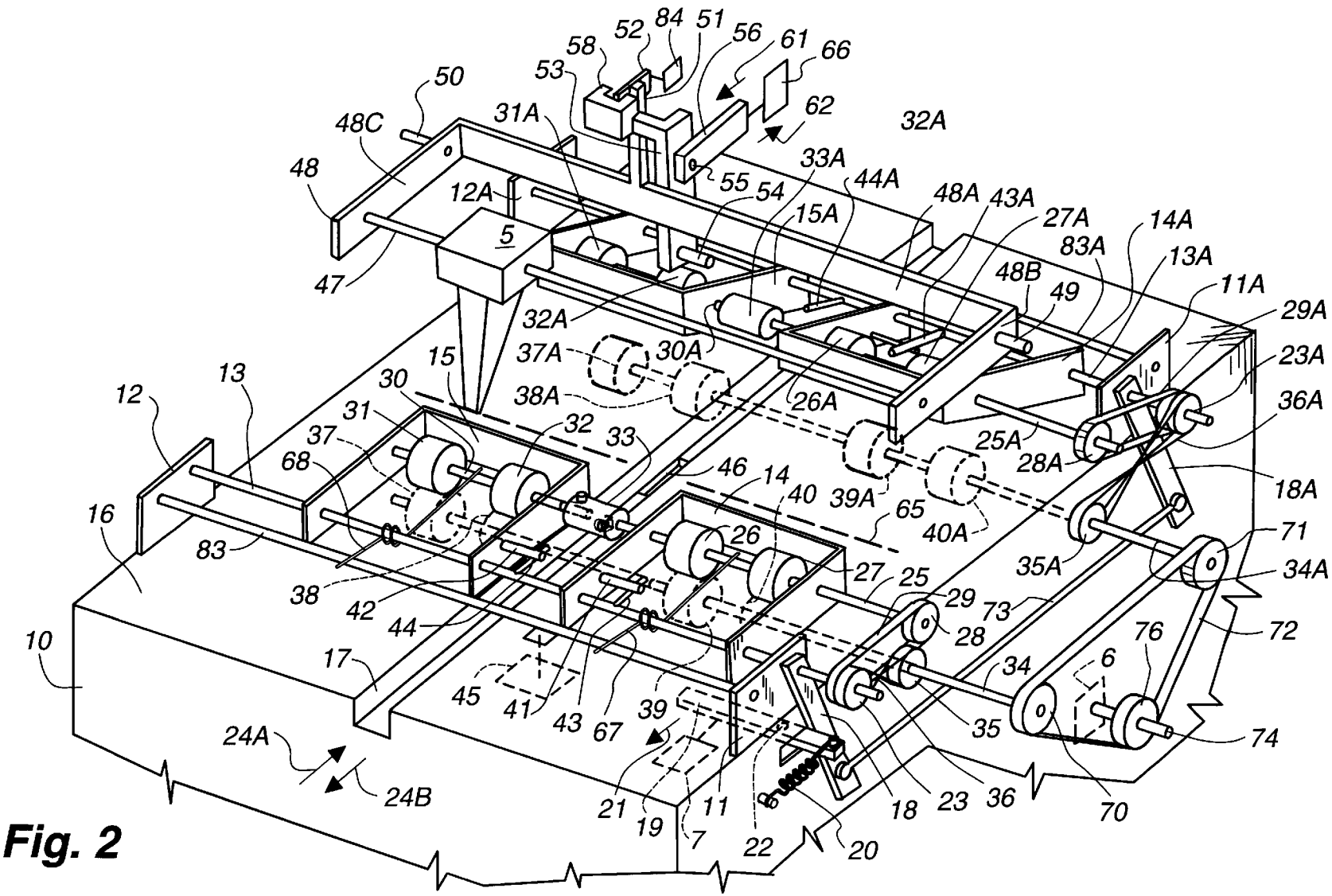
FIG. 2 shows the structure of the printer of the present invention.

FIG. 2 shows an example of a printer structure in accordance with the present invention. The book with the right and left pages being opened is supported on a supporting surface 16, and a groove or channel 17 is provided at a center portion of the supporting surface 16. The book 2, such as the diary or passbook shown in the FIG. 1, is supported on the supporting surface 16 and is fed in a direction of arrow 24A with the bound portion 1 being positioned within the groove or channel 17, as a print operation is performed. When the print operation is completed, book 2 is ejected in the direction of arrow 24B. Supporting members 11, 12, 11A and 12A are mounted on the planar supporting surface 16.

A supporting shaft 13 is pivotally mounted on the supporting members 11 and 12 above the supporting surface 16 so that the shaft 13 is parallel to the supporting surface 16 and perpendicular to the direction of the channel 17. Supporting shaft 13A is pivotally mounted on the supporting members 11A and 12A above the supporting surface 16 so that the shaft 13A is parallel to the supporting surface 16 and the supporting shaft 13, and is perpendicular to the direction of the channel 17. Since a structure of a feeding mechanism mounted on the supporting members 11 and 12 is the same as that of a feeding mechanism mounted on the supporting members 11A and 12A, but a mounting direction of the feeding mechanism on the supporting members 11 and 12 is opposite to a mounting direction of the feeding member on the supporting members 11A and 12A, only the detail of the mechanism on the supporting members 11 and 12 is described.

Each of the parts of the mechanism on the supporting members 11A and 12A is represented by the same reference number as its counterpart in the mechanism on the members 11 and 12 with the exception of the addition of the letter "A". Therefore, the following description also describes the operation of the feeding mechanism on the supporting members 11A and 12A.

Description of the Printing Operation of the Printer

Figure 7:
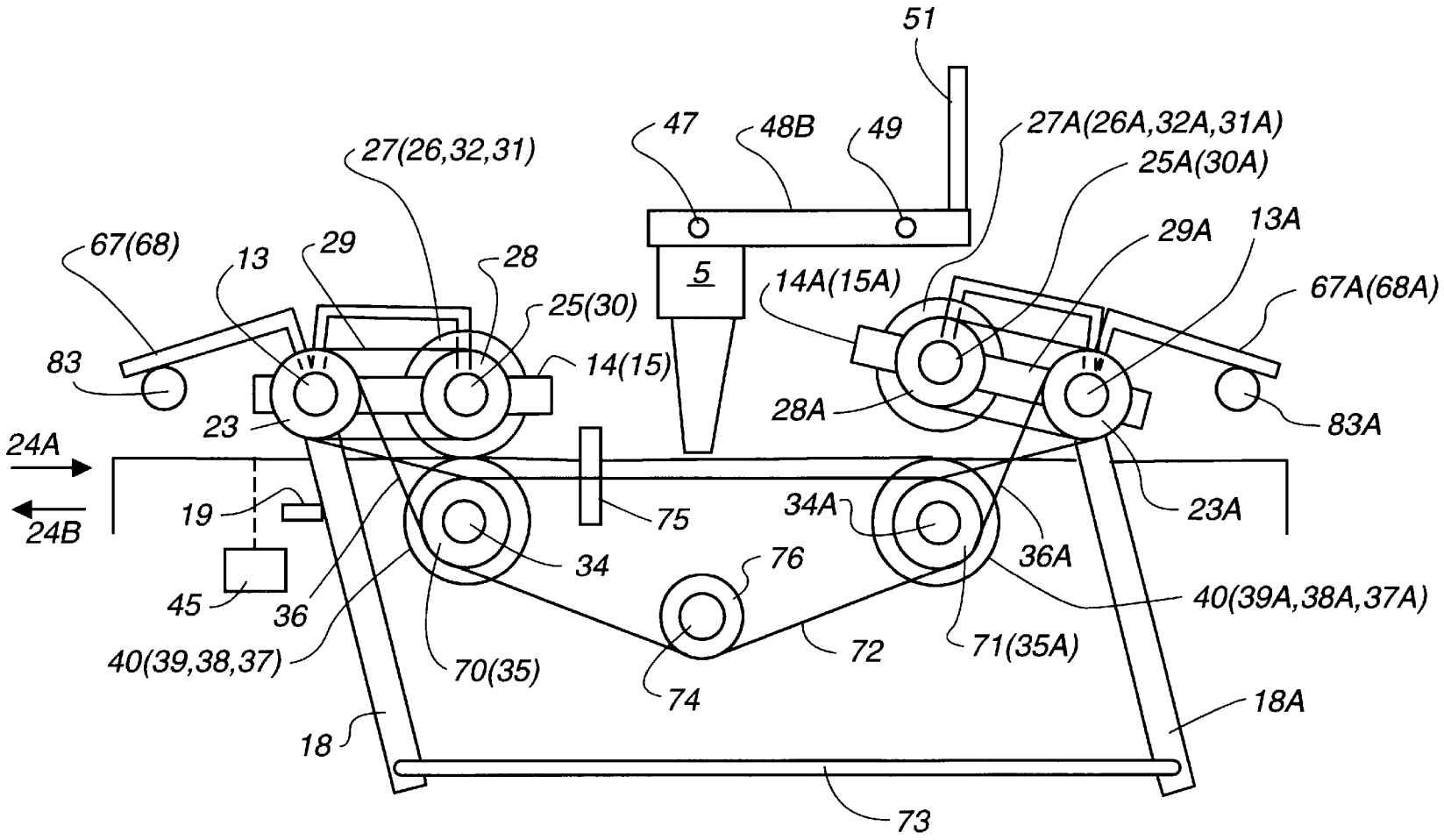
FIG. 7 shows the right side of the printer shown in the FIG. 2.

The printing operation of the printer in accordance with the present invention is here described with reference to FIGS. 2 and 7. FIG. 7 shows the structure of the right side of the printer shown in the FIG. 2. The two feeding mechanisms are shown in the FIG. 7. The supporting shaft 13 of the left side mechanism is pivoted on the supporting members 11 and 12, and a lever 18 is fixed to the shaft 13 whereby the shaft 13 is rotated by a predetermined angle by the movement of the lever 18. When the shaft 13 is rotated by the lever 18 in a counter clockwise direction, supporting frames 14 and 15 fixed on the shaft 13 and all feeding rollers 26, 27, 31 and 32 mounted on the frames which are raised from the supporting surface 16 whereby a clearance for inserting the book 2 is formed between the rollers and the supporting surface 16.

The lever 18 of the left side mechanism and a lever 18A of the right side mechanism are coupled by a link 73, whereby when the left side supporting frames 14 and 15 are placed on the supporting surface 16, the right side supporting frames 14A and 15A are moved to an upward position, and when the left side supporting frames 14 and 15 are moved to an upward position, the right side supporting frames 14A and 15A are placed on the supporting surface 16.

As shown in FIG. 7, a stopping member 75 (not shown in the FIG. 2) is provided. The stopping member 75 is moved between the protruded position shown in the FIG. 7 for stopping the movement of the book and the retracted position. The movement of the stopping member is performed by a mechanism well known in the art.

When power to the printer is turned on, drive source 7 is activated to move the lever 19 in the direction of an arrow 21 in FIG. 2, thereby the left side supporting frames 14 and 15 in FIGS. 2 and 7 are pivoted around the supporting shaft 13 in the counter clockwise direction by the predetermined angle, thereby the feeding rollers 31, 32, 26, and 27 are raised from the supporting surface 16, and the stopping member 75 is moved to the raised position. This condition is a standby condition of the printer.

The operator places book 2 with the pages opened as shown in FIG. 1 into the feeding path in the direction of the arrow 24A. The bound portion 1 of the book 2 is loosely positioned within the channel 17. When the operator turns on a start button located on an operator panel, a detecting device 45 generates a detecting signal indicating the presence of the book 2 in the path. The detecting device 45 directs the light onto the book 2 and detects the reflected light from the book 2. A control device 8 (FIG. 3) responds to the detecting signal, and moves the stopping member downwardly, and deactivates the drive source 7, thereby the lever 18 is rotated around a pivot point 22 in the clockwise direction by the action of a spring 20 to move the left side feeding rollers 31, 32, 26 and 27 to the surface of the pages of the book 2. The contact of these rollers to the left and right pages of the book 2 is described hereinafter.

The left side lever 18 and the right side lever 18A are coupled by the link 73, so that the right side rollers 31A, 32A, 26A and 27A are raised. This condition is shown in the FIG. 7 although book 2 is not shown in the FIG. 7. Next, the control device 8 activates the stepper motor 6. The stepper motor 6 rotates the shaft 74 of the pulley 76 in the clockwise direction, so that all feeding rollers 37, 38, 39, 40, 37A38A, 39A and 40A mounted below the supporting surface 16 are rotated in the clockwise direction, and all feeding rollers 31, 32, 26, 27, 31A, 32A, 26A and 27A mounted on the supporting frames 14, 15, 14A and 15A are rotated in the counter clockwise direction, so that the book 2 is fed in the direction of arrow 24A.

Control device 8 knows the distance of the movement of the book 2 by counting the number of the steps of the stepper motor 6. When a line is to be printed on book 2 when it reaches a point below a print head 5, control device 8 deactivates stepper motor 6, and performs the print operation of this one line by moving the print head 5 along a guide shaft 47. When the print operation of the one line is completed, control device 8 raises print head 5, and activates the stepper motor 6 to feed book 2 in the direction of arrow 24A until the next line to be printed reaches a location below the print head 5, and the print operation of the next line is performed.

These print operations are repeated until the leading portion of book 2 reaches a location below the right side rollers 31A, 32A, 26A and 27A. When the control device 8 detects this condition, control device 8 activates the driving source 7, whereby the lever 19 is rotated around the pivot point 22 in the direction of arrow 21, so that the left side supporting frames 14 and 15 are rotated around the supporting shaft 13 in the counter clockwise direction, and the feeding rollers 31, 32, 26 and 27 are raised, while the right side supporting frames 14A and 15A are moved downwardly so that the feeding rollers 31A, 32A, 26A and 27A are moved to the surface of the pages of the book 2. After this time point, the feeding of the book 2 is performed by the right side feeding rollers 31A,32A, 26A and 27A.

Control device 8 activates the stepper motor 6, whereby the book 2 is fed until the next line reaches below the print head at which point control device 8 activates print head 5 to print this line. When all the lines have been printed, the control device 8 rotates the stepper motor 6 in the reverse direction to feed the book 2 in the direction of the arrow 24B to eject the book 2. When book 2 reaches below the left side feeding rollers 31, 32, 26 and 27, this condition is detected by the control device 8, and control device 8 stops stepper motor 6 and deactivates the driving source 7,so that the left side feeding rollers 31, 32, 26 and 27 moves downwardly to the surface of the pages. Control device 8 rotates stepper motor 6 in the reverse direction to eject book 2 in the direction of the arrow 24B.

Description of Control System of the Printer

Figure 3:
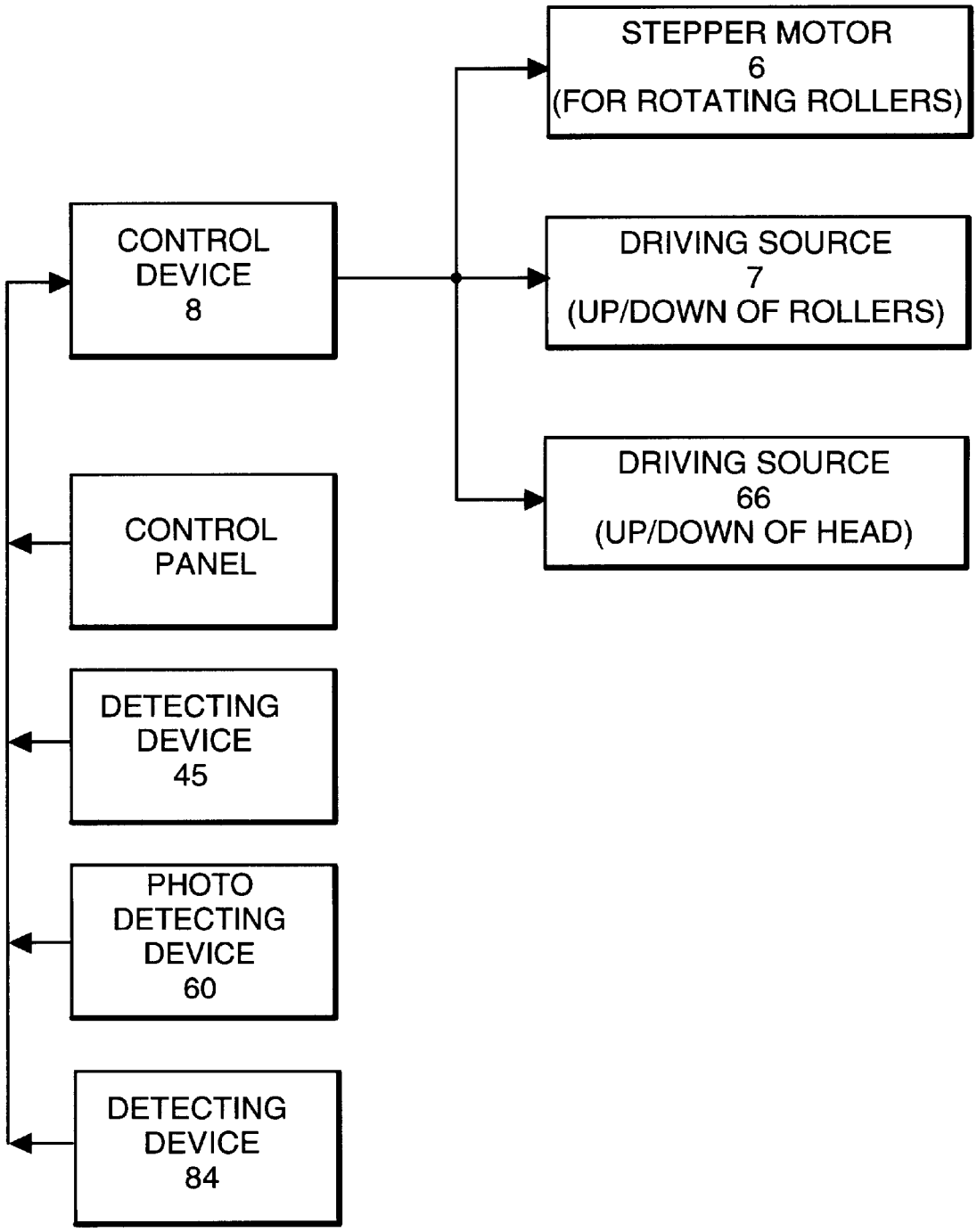
FIG. 3 shows the control system of the printer of the present invention.

FIG. 3 shows a block diagram of the control system of the printer. The control system controls the entire operation of the printer. Control device 8 responds to the detected signals from detecting devices 45, 84 or 60 to control the operation of driving motor 6, driving source 7, driving source 66 and the print head 5. The general operation of control device 8 was described hereinbefore, and the remaining operation of control device 8 will be described hereinafter.

Description of the Feeding Mechanism

The feeding mechanism is described with reference to FIG. 2. As described hereinbefore, the structure of a feeding mechanism mounted on the supporting members 11 and 12 is the same as that of a feeding mechanism mounted on the supporting members 11A and 12A, the feeding mechanism on the supporting members 11 and 12 is described. A fixed shaft 83 is supported by the supporting members 11 and 12. The fixed shaft 83 supports the rear ends of the springs 67 and 68. The springs 67 and 68 are loosely wound around the shaft 13, and the leading portions of the springs engage with the rotating shafts 25 and 30 to bias the shaft 25 and 30 towards the supporting surface 16. The shaft 83A which is the same as the shaft 83 is provided in the feeding mechanism on the supporting members 11A and 12A, and the similar springs 67A and 68A are provided. These springs are not shown in FIG. 2.

Supporting members 11 and 12 are provided on the opposite ends of the supporting surface 16 of the frame 10, and the supporting shaft 13 is pivotally supported on the supporting members 11 and 12, with the shaft 13 being parallel to the supporting surface 16. In the printer in accordance with the present invention, the supporting shaft 13, which is kept in parallel to the supporting surface 16 of the frame 10, is treated as the positional reference for mounting the components or parts of the printer.

As shown in FIG. 2, channel 17 is provided in the surface 16 at a middle point between the supporting members 11 and 12. The direction of channel 17 is perpendicular to the supporting shaft 13. The depth and width are determined to loosely receive the bound portion 1 of book 2. Detecting device 45 is mounted at the entrance point of the book 2 of the supporting surface of the frame 10. The detecting device 45 detects only the entrance of the book 2, and detects the reflected light from the book 2. This kind of the detecting device is well known in the art, a detailed description is here omitted.

Lever 18 is fixed to one end of the supporting shaft 13 and engages with the driving lever 19. Driving lever 19 is mounted to frame 10 at the pivoting point 22, and is biased by the spring 20 in a direction which is opposite to direction 21. When the driving lever 19 is moved by driving source 7 provided within the frame 10 in the direction of the arrow 21, the lever 18 is rotated in the counter clockwise direction, thereby rotating supporting shaft 13 on supporting members 11 and 12 in the counter clockwise direction. During the time lever 18 is not pivoted, the supporting shaft 13 is not moved.

Pulley 23 is rotatably mounted on one end of the supporting shaft 13. One end of each of the supporting frames 14 and 15 is pivotally supported on the supporting shaft 13. The supporting frames 14 and 15 independently pivot on the supporting shaft 13. A rotating shaft 25 is mounted on the other end of the supporting frame 14, i.e., on the downstream side of supporting shaft 13 as viewed in the direction of arrow 24A, in parallel with the supporting shaft 13. Accordingly, the rotating shaft 25 is kept in parallel to both the supporting surface 16 of frame 10 and the supporting shaft 13. The feeding rollers 26 and 27 are fixed on the rotating shaft 25. A pulley 28 is fixed to one end of the rotating shaft 25. The pulleys 28 and 23 are coupled by a belt 29, hence the pulley 28 and the feeding rollers 26 and 27 are rotated in the same rotating direction as that of the pulley 23.

A rotating shaft 30 is mounted on the other end of supporting frame 15, i.e., on the down stream side of the supporting shaft 13 as viewed in the direction of arrow 24A, in parallel with the supporting shaft 13. Accordingly, the rotating shaft 30 is kept in parallel to both the supporting surface 16 of the frame 10 and the supporting shaft 13, as in the case of the rotating of shaft 25. The feeding rollers 31 and 32 are fixed on rotating shaft 30. Feeding rollers 26, 27, 31 and 32 have the same diameters, and are made of the same material. When the lower ends of the feeding rollers 26, 27, 31 and 32 are positioned on the supporting surface 16, the rotating shafts 25 and 30 are so mounted that the central axes of rotating shafts 25 and 30 are aligned with one another.

Rotating shafts 25 and 30 are coupled by an universal joint 33. Accordingly, when the pulley 28 is rotated in the counter clockwise direction, i.e. in the direction for feeding the book in the direction 24A, the feeding rollers 26, 27, 31 and 32 are rotated at the same rotating speed, thereby applying the same feeding force to left and right side pages of the book 2. A rotating shaft 34 is mounted within frame 10. Rotating shaft 34 is parallel with supporting shaft 13, the rotating shaft 25, the rotating shaft 30 and the supporting surface 16 of the frame 10.

In order to simplify the drawing, the supporting mechanism of the rotating shaft 34 is not shown. The rotating shaft 34 is rotated by the driving motor 6 in an opposite direction to the rotating direction of the upper side feeding rollers 26, 27, 31 and 32. A pulley 35 is fixed on one end of the rotating shaft 34, and this pulley 35 is coupled to the pulley 23 by belt 36. Belt 36 is so mounted that when the pulley 35 is rotated in the clockwise direction, the pulley 23 is rotated in the counter clockwise direction. Feeding rollers 37, 38, 39 and 40 are fixed on the rotating shaft 34 to oppose feeding rollers 31, 32, 26 and 27, respectively, as shown in the FIG. 4.

Feeding rollers 37, 38, 39 and 40 have the same diameters, and are made of the same material. An example of the material is silicone rubber. The rotating shaft 34 is mounted within the frame 10, so that the level of the upper ends of the feeding rollers 37, 38, 39 and 40 is higher than the supporting surface 16 by a small distance. The feeding rollers 37, 38, 39 and 40 protrude through apertures formed in the supporting surface 16. For the reasons that the pulley 35, 23 and 28 have the same outer diameters, and the feeding rollers 31, 32, 26, 27, 37, 38, 39 and 40 have the same diameters and the reasons stated with respect to the FIG. 8, book 2 can be fed by the same feeding forces, as shown in the FIG. 4.

A bar element 41 is fixed on a side portion, which is perpendicular to the supporting shaft 13 of the supporting frame 14, and a lever 43 is fixed on the supporting shaft 13. When the detecting device 45 does not detect the presence of the book 2, the control device 8 does not activate the driving source 7, and the lever 19 is maintained at the position shown by the dotted line in the FIG. 2, and the feeding rollers 31, 32, 26 and 27 contact feeding rollers 37, 38, 39 and 40, respectively.

In this condition, the lever 43 does not raise the bar element 41. In the same manner, a bar element 42 is fixed on a side portion of the supporting frame 15, which is perpendicular to the supporting shaft 13. Lever 44 is fixed on the supporting shaft 13. When the detecting device 45 does not detect the presence of the book 2, the control device 8 does not activate the driving source 7, and the lever 19 is maintained at the position shown by the dotted line in the FIG. 2, and the feeding rollers 31, 32, 26 and 27 contact to the feeding rollers 37, 38, 39 and 40, respectively. In this condition, lever 44 does not raise the bar element 42. When the detecting device 45 detects the presence of book 2, control device 8 activates driving source 7 to rotate the lever 19 around the pivot point 22 in the direction of the arrow 21, whereby the lever 18 is rotated in the counter clockwise direction in FIG. 2, so that supporting shaft 13 and the lever 43 and 44 are also rotated in the counter clockwise direction to raise the bar elements 41 and 42.

As a result, supporting frames 14 and 15 are rotated around shaft 13 in the counter clockwise direction in the FIG. 2, whereby the upper feeding rollers 26, 27, 31 and 32 are moved upwardly, to produce a clearance from the lower feeding rollers 39, 40, 37 and 38. The clearance is designed to have a lager size than an estimated largest thickness of the book 2, thereby allowing the operator to insert the book 2 into the feeding path below the feeding rollers 31, 32, 26 and 27 until the leading edge of the book 2 is stopped by the stopping member 75.

As described hereinbefore, one end of the spring 67 is fixed on the fixed shaft 83, and the other end engages the rotating shaft 25 at the middle point between the feeding rollers 26 and 27, to bias the feeding rollers 26 and 27 in the clockwise direction in the FIG. 2. In the same manner, one end of the spring 68 is fixed on the fixed shaft 83, and the other end engages the rotating shaft 30 at the middle point between the feeding rollers 31 and 32, to bias the feeding rollers 31 and 32 in the clockwise direction in FIG. 2.

Figure 4:
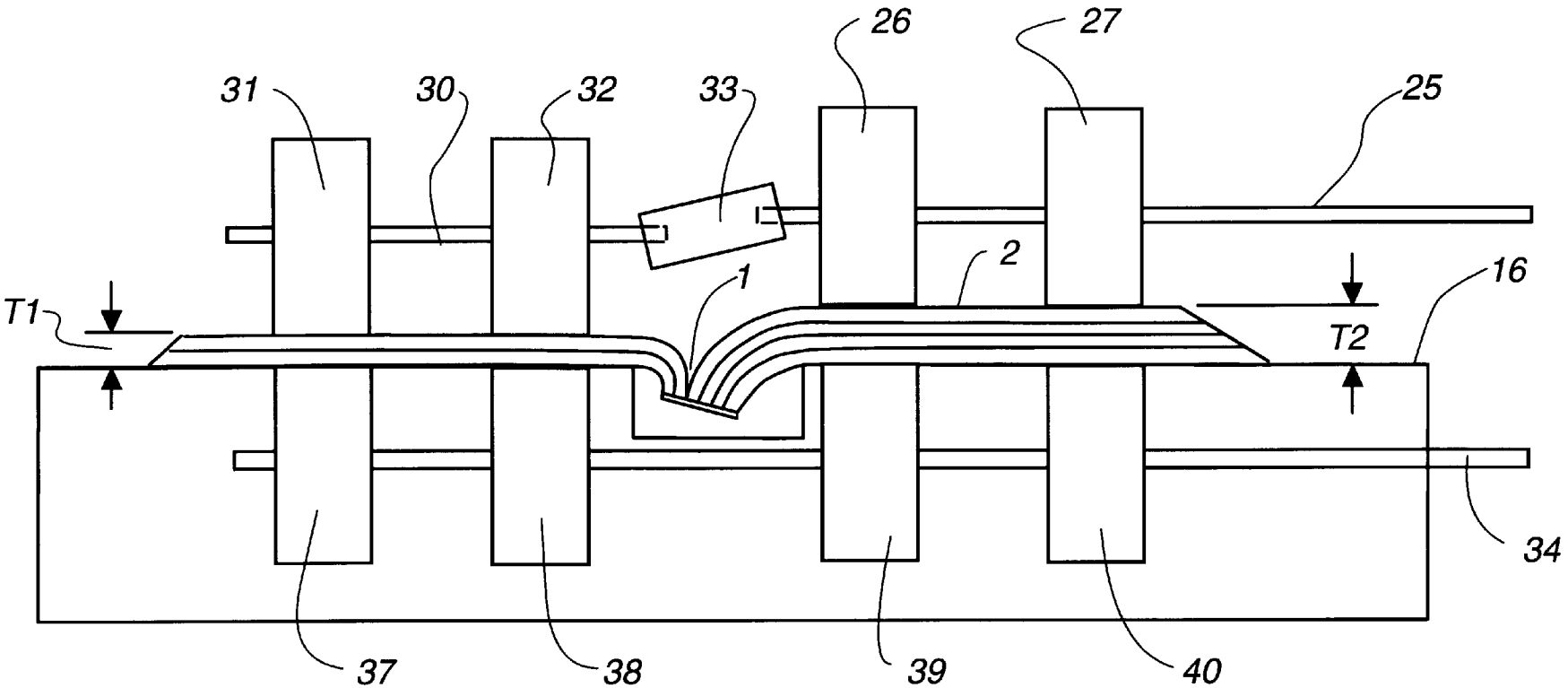
FIG. 4 shows the positional relationship of the feeding rollers to the left side page and the right side pages.

With reference FIG. 4, the operation of the feeding rollers is now described. As shown in the FIG. 4, it is assumed that when the book 2 is opened, the number of pages in the left side is smaller than that in the right side, hence the thickness T1 of the left side pages is smaller than the thickness T2 of the right side pages. During such feeding operations of book 2, the feeding rollers 31 and 32 engaging the left side pages are moved upwardly by the height T1 against the bias force of the spring 68, while the feeding rollers 26 and 27 engaging the right side pages are moved upwardly by the height T2 against the bias force of the spring 67.

As is apparent from FIG. 4, during the movement of the feeding rollers 31 and 32, the shaft 30 and therefore the feeding rollers 31 and 32 are maintained in parallel to the supporting surface 16 of the frame 10, since the rotating shaft 30 is maintained at the parallel relation to the supporting shaft 13 by the rigid supporting frame 15. In the same manner, during the movement of the feeding rollers 26 and 27, the shaft 25 and therefore the feeding rollers 26 and 27 are maintained in parallel to the supporting surface 16 of the frame 10, since the rotating shaft 25 is maintained at the parallel relation to the supporting shaft 13 by the rigid supporting frame 14.

Each set of rollers, i.e. 31 and 32, and 26 and 27, are independently moved keeping the parallel relationship with the supporting surface 16, since the rigid supporting frames 14 and 15 can be independently pivoted on the supporting shaft 13, and the rotating shafts 30 and 25 are coupled by the universal joint 33. As a result, the left side upper feeding rollers 31 and 32 and the left side lower feeding rollers 37 and 38, and the right side upper feeding rollers 26 and 27 and the right side lower feeding rollers 39 and 40 can engage with the left side pages and the right side pages, respectively so that the feeding speed at the left side pages is equal to the feeding speed at the right side pages. The universal joint 33 transmits only the rotating torque from the rotating shaft 25 to the rotating shaft 30, and the force of the spring 67 for biasing the rotating shaft 25 and the feeding rollers 26 and 27 to the supporting surface 16 is not transmitted to the left side rotating shaft 30 and the force of the spring 68 for biasing the rotating shaft 30, and the feeding rollers 31 and 32 to the supporting surface 16 is not transmitted to the right side rotating shaft 25.

Hence, the feeding rollers on the supporting frames 14 and 15 are urged by only the bias force of the spring and their weight, whereby substantially the same feeding forces are supplied to the left side pages and the right side pages to feed the book 2 in the direction which is perpendicular to the supporting shaft 13. In this manner, in the printer of the present invention, the feeding rollers apply the same feeding force, and the each of the feeding rollers 26, 27, 31, and 32 is urged to the surface of the page by the same biasing force, as described below, whereby the book 2 is fed in the correct direction indicated by the arrow 24A or 24B without being skewed.

Figure 8:
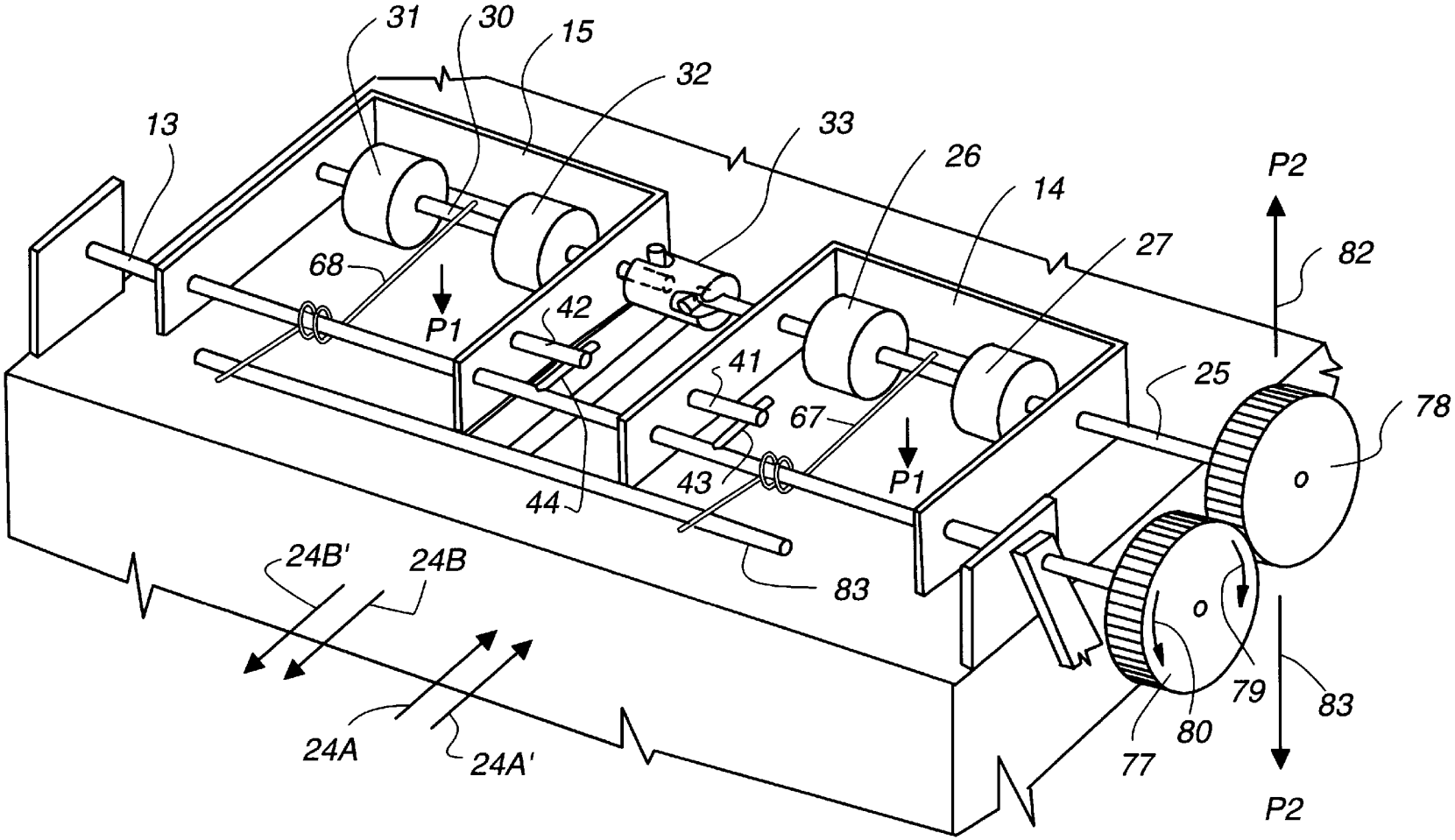
Fig. 8 Prior Art
FIG. 8 shows the problem of the prior mechanism for transmitting the rotating force.

In the present invention, the rotating shaft 25 is driven by the belt 29. In contradistinction, FIG. 8 shows a mechanism and a problem thereof in the case that gears 78 and 77 are used in the mechanism of the present invention. As shown in FIG. 8, a gear 78 is fixed on the rotating shaft 25, and this gear 78 is driven by a gear 77 rotated on shaft 13. In this mechanism using the gear connection, the following problem occurs.

It is assumed that the gear 77 is rotated in the direction of the arrow 80 to feed the book 2 in the direction of the arrow 24B. As a result, the tooth of the gear 77 engages with the tooth of the gear 78 so that gear 78 is raised up in the direction of arrow 82. Since gear 78 is fixed to rotating shaft 25, shaft 25 and feeding rollers 26 and 27 are also raised upwardly in the direction of arrow 82. The force for raising gear 78 and feeding rollers 26 and 27 is not transmitted to left side rotating shaft 30, since the rotating shaft 30 is coupled to the rotating shaft 25 by universal joint 33. It is assumed that the downward force applied by springs 67 and 68 is P1, and the upward force in the direction of arrow 82 is P2. Then, the force applied to the rotating shaft 25 and 30 is represented by the following formula:

Force to the rotating shaft 25: P1−P2

Force to the rotating shaft 30: P1

That is, when book 2 is fed in the direction of the arrow 24B, the force applied by the feeding rollers 26 and 27 is smaller than the force applied by the feeding rollers 31 and 32. Hence book 2 is fed in a direction of an arrow 24B'. It is assumed that the gear 77 is rotated in the direction of the arrow 79 to feed the book 2 in the direction of the arrow 24A. In this case, gear 78 is moved downwardly in the direction of an arrow 83.

Since gear 78 is fixed on the rotating shaft 25, this rotating shaft 25 and the feeding rollers 26 and 27 are also moved or urged downwardly in the direction of the arrow 83. The rotating shaft 30 is coupled to the rotating shaft 25 by the universal joint 33. Hence, the downward force applied to gear 78 is not transmitted to the rotating shaft 30. The force applied to the rotating shafts 25 and 30 are represented by the following formula:

Force to the rotating shaft 25: P1+P2

Force to the rotating shaft 30: P1

That is, when book 2 is fed in the direction of the arrow 24A, the force applied by the feeding rollers 26 and 27 is larger than the force applied by the feeding rollers 31 and 32, the result is book 2 is fed in a direction of an arrow 24A'. In contradistinction, in the present invention wherein the pulley 28 is fixed on the rotating shaft 25, and this pulley 28 is rotated by the belt 29, the above force P2 generated in depending upon the rotating direction is not generated, whereby the feeding rollers 31, 32, 26 and 27 are urged onto the pages of the book 2 by only the force of the springs 67 and 68. Since the force applied by the spring 67 is selected to be equal to that of the spring 68, the feeding rollers 31, 32, 26 and 27 are urged onto the page of the book 2 by the same biasing force.

As seen in FIG. 4, the upper feeding rollers 31 and 32 and the lower feeding rollers 37 and 38 grip the two portions of the left side pages to feed the left side pages along the direction parallel to the bound portion 1 of the book 2, the left side pages can be fed in the correct feeding direction. The same feed operation is performed in the right side pages. The upper feeding rollers 26 and 27 and the lower feeding rollers 39 and 40 grip the two portions of the right side pages to feed the right side pages along the direction parallel to the bound portion 1 of book 2, the right side pages are fed in the correct feeding direction. As a result, the entire book 2 is fed in the correct feeding direction of arrows 24A or 24B.

Another mechanism using one pair of the feeding roller for each page, for example, one pair (31 and 37) in the left pages, and one pair (27 and 40) in the right pages was experimentally used in the printer. It was found that both the mechanism using the two pairs of the feeding rollers for each side (first mechanism) as shown in the FIG. 4 and another mechanism using one pair for each side (second mechanism) indicated the better feeding operation than that performed in the mechanism shown in the FIG. 8. The experimental comparison of the operation of the first and second mechanisms indicated that the feeding operation of the first mechanism was better than the that of the second mechanism. The experiment for the second mechanism was performed by positioning one pair of feeding rollers for each page at various locations along the pages.

In first example, one pair was located on an inside area on each page, that is, one pair is located at the position of the rollers 32 and 38 on the left page, and one pair being located at the position of the rollers 26 and 39 as shown in the FIG. 4. In the second example, one pair was located on an outside area on each page. That is, one pair is located at the position of the rollers 31 and 37 on the left page, and one pair being located at the position of the rollers 27 and 40. It was found that the first example produced larger skew than the second example.

In the second example, the skew was smaller than the first example, but an undesired wind up at the portion near to the bound portion 1 of the uppermost sheet of each page was observed, and when the print head is moved along the print line which is parallel to the supporting shaft 13, the wound up portion of each upper most sheet of each page is depressed by the print head, and an undesired crease was produced in each page. Such an undesired crease was not produced in the first mechanism using the two pairs of the feeding rollers for each page as shown in the FIG. 4.

As described hereinbefore, since the pulley 23 is rotatably supported on the supporting shaft 13 and coupled to the pulley 28 by the belt 29, the tension of the belt 29 is maintained at the designed value even if the supporting frames 14 and 15 are rotated around the supporting shaft 13. In this manner, the supporting shaft 13 operates as the support element for rotatably supporting the pulley 23 for transmitting the driving force, and also performs the function for pivoting the supporting frames 14 and 15 to move upwardly the feeding rollers 26, 27, 31 and 32, and also performs the function for supporting the first spring 67 and the second spring 68. In this manner, the supporting shaft 13 performs the three functions, whereby the number of the parts can be decreased, and the space of the printer and the cost can be decreased.

As shown in the FIGS. 2 and 7, the mounting direction of the supporting frames 14 and 15 pivotally mounted on the supporting shaft 13 is opposite to the mounting direction of the supporting frames 14A and 15A pivotally mounted on the supporting shaft 13A, thereby the feeding rollers on the right side mechanism are opposite to the feeding rollers on the left side mechanism, as shown in the FIG. 7. The two levers 18 and 18A are coupled by the link 73. This arrangement realizes the following meritorious effects.

When the right side supporting frames 14A and 15A are moved upwardly, as shown in the FIG. 7, the springs 67A and 68A of these supporting frames bend upwardly, since the rear ends of these springs are supported on the fixed shaft 83*a*, the middle portion of these springs are wound around the supporting shaft 13*a*, and the leading portions of these springs are raised upwardly by the rotating shafts 25A and 30A. When the lever 19 is moved in the rightward direction in FIG. 7 to raise the left side supporting frames 14 and 15 and to move down the right side supporting frames 14A and 15A, the levers 18 and 18A are rotated in the counter clockwise direction. Springs 67A and 68A on the right side of supporting frames 14A and 15A tend to return from the wound condition to the relaxed condition at the rotation of the right side supporting frames 14A and 15A.

That is, the force stored in the right side springs 67A and 68A of the supporting frames 14A and 15A assist the movement of the lever 18A in the counter clockwise direction, whereby they assist the upward movement of the left side supporting frames 14 and 15. In the same manner, the wound springs 67 and 68 of the supporting frames 14 and 15 at the raised position assist the upward movement of the right side supporting frames 14A and 15A. Thus the springs perform the two functions, that is, the function for depressing the feeding rollers to the pages of the book 2, and the additional function described above.

Description of the Mechanism for Vertically Moving Print Head

As is illustrated in FIG. 2, print head 5 is a dot matrix type print head wherein a plurality of print wires are arranged in a matrix. Print head 5 is slidably mounted on a guide bar 47. The reciprocal movement of the print head in the rightward or leftward direction on guide bar 47 is controlled by control device 8. Since such control of the print head is well known in the art, a detail description thereof is here omitted. Also as is conventional, an ink ribbon is mounted opposite the face of print head 5. The ink ribbon is not shown in FIG. 2 in the interests of simplifying the drawing.

A supporting frame 48 includes a long member 48A extending in parallel to the supporting shaft 13, and two short members 48B and 48C which extend from the both ends of the member 48*a* in parallel to the supporting surface 16. The ends of the guide bar 47 are fixed to the end portion of each of the members 48B and 48C. Pivoting shafts 49 and 50 are attached at the positions on the members 48B and 48C adjacent to the long member 48A, respectively. These pivoting shafts 49 and 50 are pivotally mounted on a supporting frame fixed on the frame 10. The supporting frame is not shown in the drawing.

Figure 5:
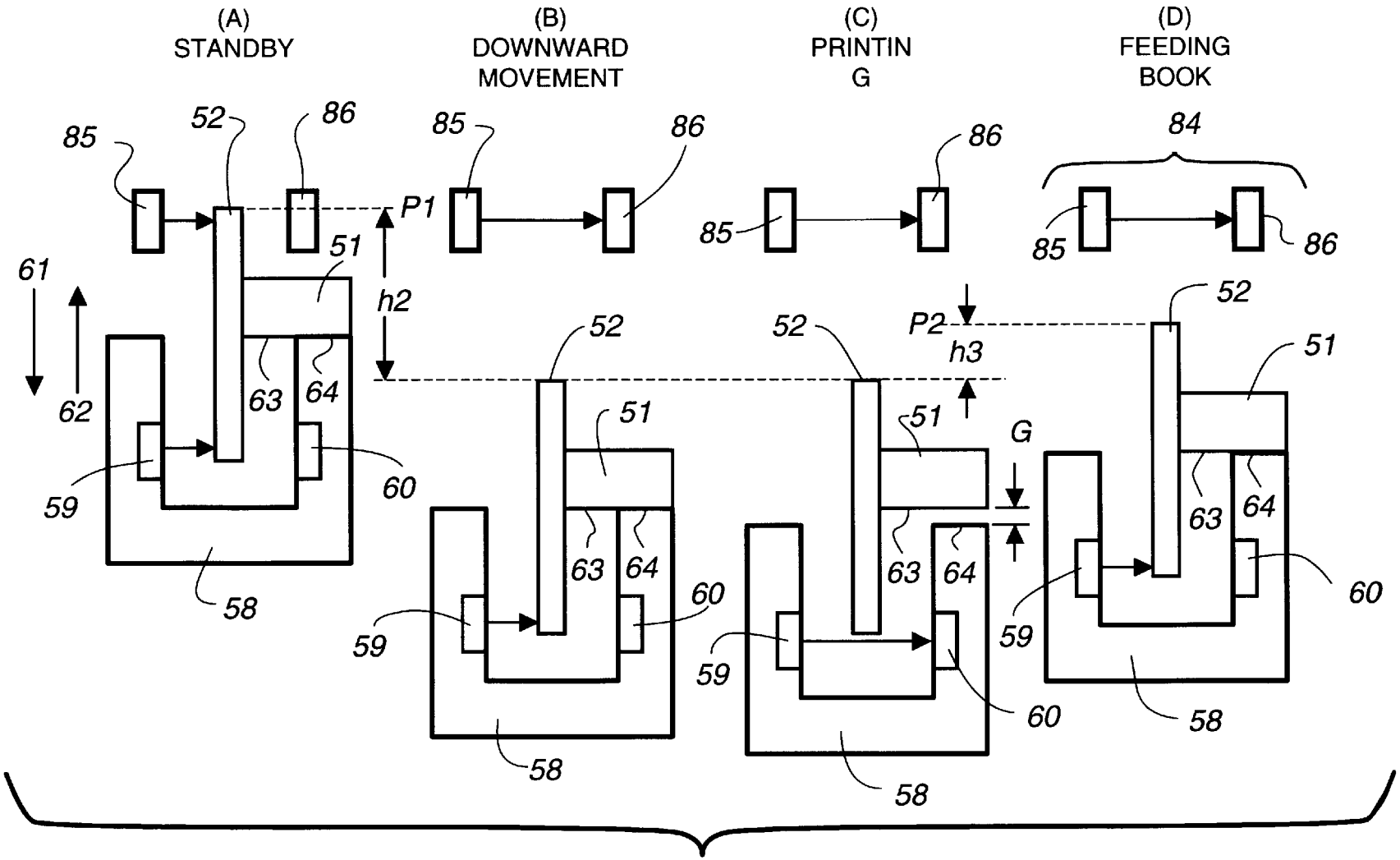
FIG. 5 shows the positional relationship of the detecting devices to the various parts of the printer.

A vertical member 51 extends from the member 48A of the supporting frame 48, as shown in the FIGS. 2, 5 and 7. A plate member 52 is fixed on a surface of the vertical member 51, which is parallel to the feeding direction (the direction of the arrows 24A and 24B) of book 2. A pivoting bar 54 fixed on the lower portion of a driving lever 53 is pivotally mounted on the supporting frame, which is not shown in the drawing. A driving lever 56 is pivotally mounted on a pivot point 55 of the driving lever 53. The driving lever 56 is moved in the direction of arrow 61 or 62 by a driving source 66.

Driving source 66 includes a DC motor or a stepper motor, and a well known worm wheel mechanism or a cam mechanism for converting the rotating movement generated by the motor into the reciprocal movement in the direction of the arrow 61 or 62. Since the mechanism is well known in the art, it is not described in detail.

A supporting member 58 for mounting detecting devices 59 and 60 is fixed on the top of the driving lever 53. A detecting device 84 is supported on the supporting frame, not shown in the drawing, for detecting one edge of the plate member 52. The detecting device 84 includes a Light Emitting Diode (LED) 85 and a photodetector 86, as shown in the FIG. 5 which is a plan view of the LED 85, the photo detector 86, the supporting member 58, the vertical member 51 and the plate member 52.

Figure 6:
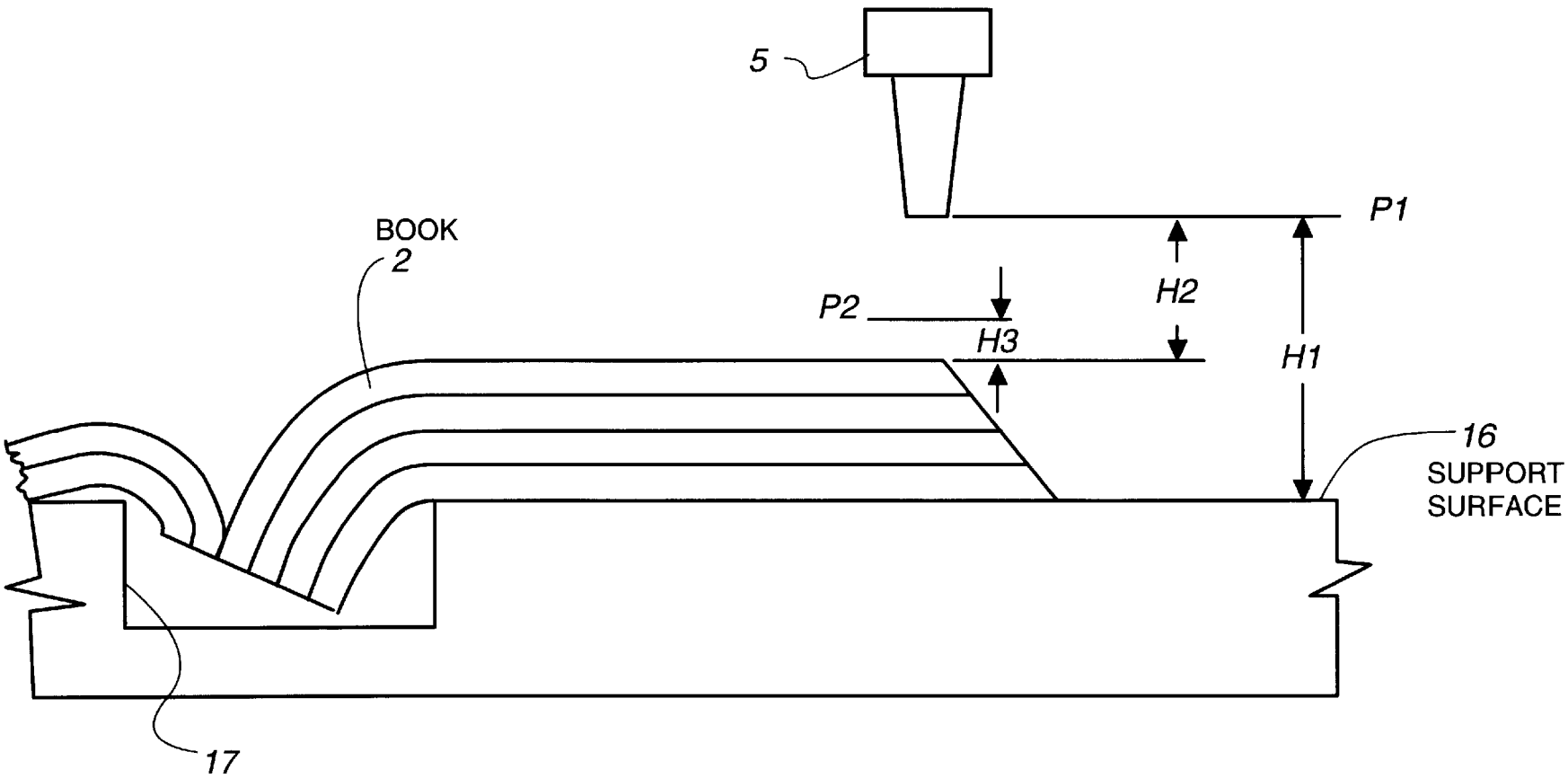
FIG. 6 shows the height of the print head from the book.

The supporting member 58 includes two recesses, an LED 59 and a photodetector 60 mounted within the recesses, respectively. With reference to FIGS. 2, 5 and 6, the movement of the print head 5 in the direction which is perpendicular to the supporting surface 16 is described. The two detecting devices are provided to control the movement of the print head 5 in the vertical direction. One of them is the detecting device 84,and it is provided at the position shown in FIG. 2. The other one is the detecting device including the LED 59 and the photodetector 60 mounted within the supporting member 58. FIG. 5 shows the relative movement of the print head 5 to LED 85, photodetector 86 of the detecting device 84, LED 59, and photodetector 60 on the supporting member 58.

In the standby mode of the printer, as shown in the FIG. 5(A), lever 56 shown in FIG. 2 is pulled in the direction of the arrow 62 by driving source 66, so that the surface 64 of the supporting member 58 pushes the surface 63 of the vertical member 51 to pivot the vertical member 51 around the pivot points 49 and 50 in the direction 62, so that the supporting frame 48 of the print head 5 is pivoted around the pivot points 49 and 50 to move the print head 5 upwardly from the supporting surface 16. When plate member 52 which is integral with the print head 5 is moved to the point at which the light from the LED 85 is blocked, the light detecting signal from the photodetector 86 is not applied to the control device 8, whereby control device 8 detects that the print head 5 has reached the standby position P1, and deactivates the driving source 66, so that the print head 5 is held in the standby position P1. Standby position P1 is the uppermost position of the print head 5, which is separated from the supporting surface 16 by the longest distance H1.

Next, print head 5 is moved downwardly from the standby position P1 to start the print operation. To this end, the control device 8 activates the driving source 66 to move the driving lever 56 in the direction of arrow 61. The print head 5 is rotated or pivoted around the pivot points 49 and 50 by its weight and a proper spring means, not shown, in the counter clockwise direction and approaches the surface of the page of book 2. During this downward movement of print head 5 from the standby position P1, plate member 52 is moved in the direction 61, so that light from LED 85 is received by the photodetector 86, and the detecting signal from detector 86 is applied to control device 8.

During the downward movement, the surface 64 of the supporting member 58 maintains engagement with the surface 63 of the vertical member 51, as shown in FIG. 5 (B). Accordingly, plate member 52 continues to block the light from LED 59 so that photodetector 60 does not supply a signal to control device 8. Control device 8 detects this condition, and recognizes that print head 5 is moving downwardly to the surface of the page of the book 2 from the standby position P1.

As shown in FIG. 6, when the lowest end of the print head 5 has landed on the page of book 2 after the downward movement of the distance H2 from the standby position P2, the plate member 52 has moved by a distance h2, as shown in FIG. 5(B), which corresponds to the distance H2. Upon landing, the movement in the counter clockwise direction of print head 5 and the supporting member 48 is stopped, so that the movement of the vertical member 51 of the member 48 and the plate member 52 in the counter clockwise direction, i.e. the direction of the arrow 61, is also stopped. It is noted that when print head 5 lands on the page, a small clearance is maintained between the print wires and the page.

After the movement of the vertical member 51 and the plate member 52 is stopped, however, driving source 66 is activated by control device 8, therefore the driving lever 56 and the supporting member 58 are moved in the direction of arrow 61 to the position at which the plate member 52 does not block the light from LED 59, as shown in the FIG. 5(C). At this time, photodetector 60 supplies the detecting signal to control device 8, which responds to the signal to deactivate the driving source 66 to stop the movement of the lever 56 and the supporting member 58.

As a result, the surface 63 of the vertical member 51 is spaced from the surface 64 of the supporting member 58 by a small gap G. In this condition, the lower end of print head 5 is landed on the page of the book 2 (but, the print wires are spaced from the page), and the printing operation is performed. The printing operation is performed by selectively activating the print wires during the period print head 5 is moved along a print line 65 shown in the FIG. 2.

Next, the operation for moving upwardly the print head 5 after the printing operation of one print line has been completed is described. It is assumed that the print mode for separately printing the left side page and the right side page is selected, and the print head 5 is landed on the left area of the right side page, and the print operation is performed in the direction from the left area to the right area of the right side page. When the print head 5 has completed the print of the one line on the right side page, control device 8 activates driving source 66 to start the movement of the lever 56 and the supporting member 58 in the direction of the arrow 62 from the position shown in the FIG. 5 (C), so that the surface 64 of the supporting member 58 engages with the surface 63 of the vertical member 51, to move the vertical member 51 of the frame 48 in the direction of the arrow 62 to raise the print head 5 from the surface of the page. During the period in which the surface 64 engages with the surface 63, the plate member 52 blocks the light from LED 59, so that the detecting signal from photodetector 60 is stopped.

If a DC motor is used as the driving source 66, control device 8 deactivates the driving source 66 after a lapse of a predetermined period from the stop of the signal of the detector 60. This predetermined period is required to stop the lower end of the print head 5 at the standby position in printing P2 which is spaced from the surface of the page of the book 2 by the distance H3.

Describing this movement with reference to FIG. 5, the plate member 52 is moved by the distance h3 corresponding to the distance H3 in the direction 62. In the case that the stepper motor is used as the motor of the driving source 66, the control device 8 counts the number of steps of the stepper motor which corresponds to the distance h3. As a result, print head 5 is raised by the distance H3 and stopped at the standby position in printing P2 above the right end of the print line. In this condition, book 2 is fed by one print line in the direction of the arrow 24A, and the print head 5 is moved downwardly to the print position of the next print line.

That is, control device 8 activates the driving source 66 to move the lever 56 in the direction of the arrow 61. After print head 5 lands on the surface of the page, photodetector 60 detects the light from the LED 59, and control device 8 responds to the signal from the photo detector 60, which indicates the landing of the print head 5, to start the print operation. In the case that the print lines of one page of the book are continuously printed, the print head 5 is moved downwardly from the standby position P1 to the first print line of the page, and is raised to the standby position in printing P2 which is lower than the position P1, after the completion of the print of one line.

That is, the print head is moved from the position P1 only when the first line is printed. During the time print head 5 is maintained at the standby position in printing P2, the feeding rollers are rotated to feed the book 2 by one line in the direction of the arrow 24A in the FIG. 2, and print head 5 is moved downwardly to the surface of the page and is landed, and the print operation is started. In this print operation, the time required to travel the distance of the vertical movement of the print head 5 can be saved, thereby increasing the printing speed.

In contradistinction, it is possible to print one print line of the left side page, and to move the print head 5 to the beginning of one line of the right side page passing through the bound portion 1, and to print this one line of the right side page. In this print mode, print head 5 is moved downwardly from the standby position P1 to the first print position of one line of the left side page, and prints this one line. After this line has been printed, the print head 5 is moved to the standby position P1, and the print head 5 is moved horizontally at the height of the position P1 to the first print position of one line of the right side page through the bound portion 1.

When print head 5 reaches to the first print position of the line of the right side page, the print head 5 is moved downwardly to start the printing operation. When the print operation of this one line is completed, print head 5 is again moved upwardly to the standby position P1, and the feeding rollers are rotated to feed the book 2 by one line, and the print head 5 is moved horizontally at the height of the position P1 to the first print position of the next line of the left side page through the bound portion 1. And, when the print head 5 reaches to the first print position of the next line of the left side page, the print head 5 is again moved downwardly to start the printing operation.

Figure 9A:
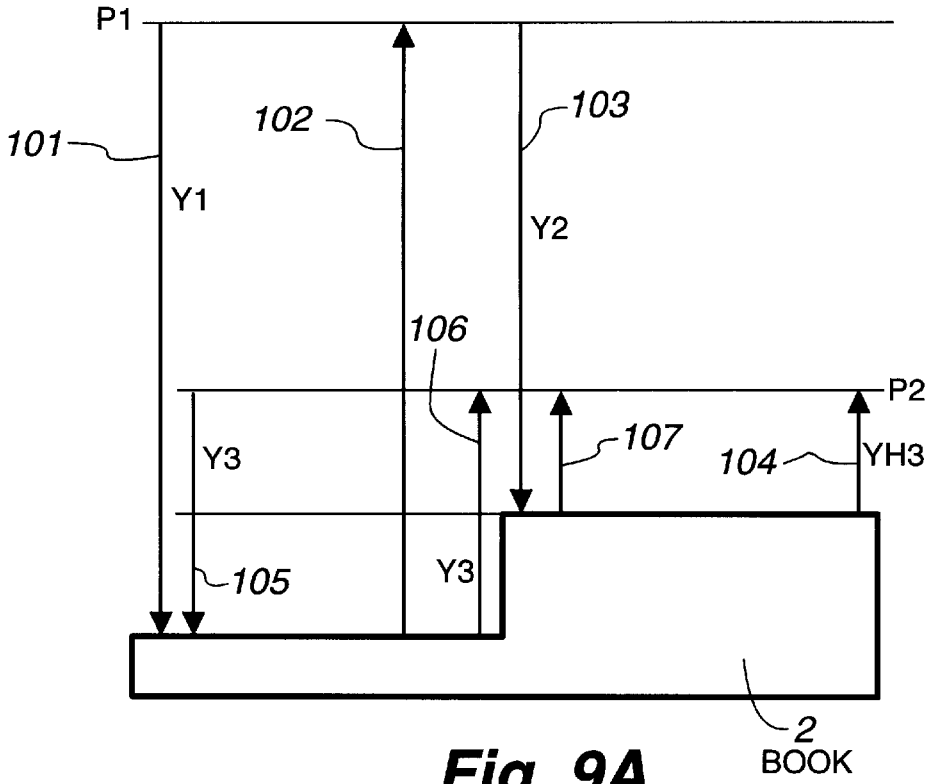
FIGS. 9(A) and 9(B) show the movement of the print head on the book.
Figure 9B:
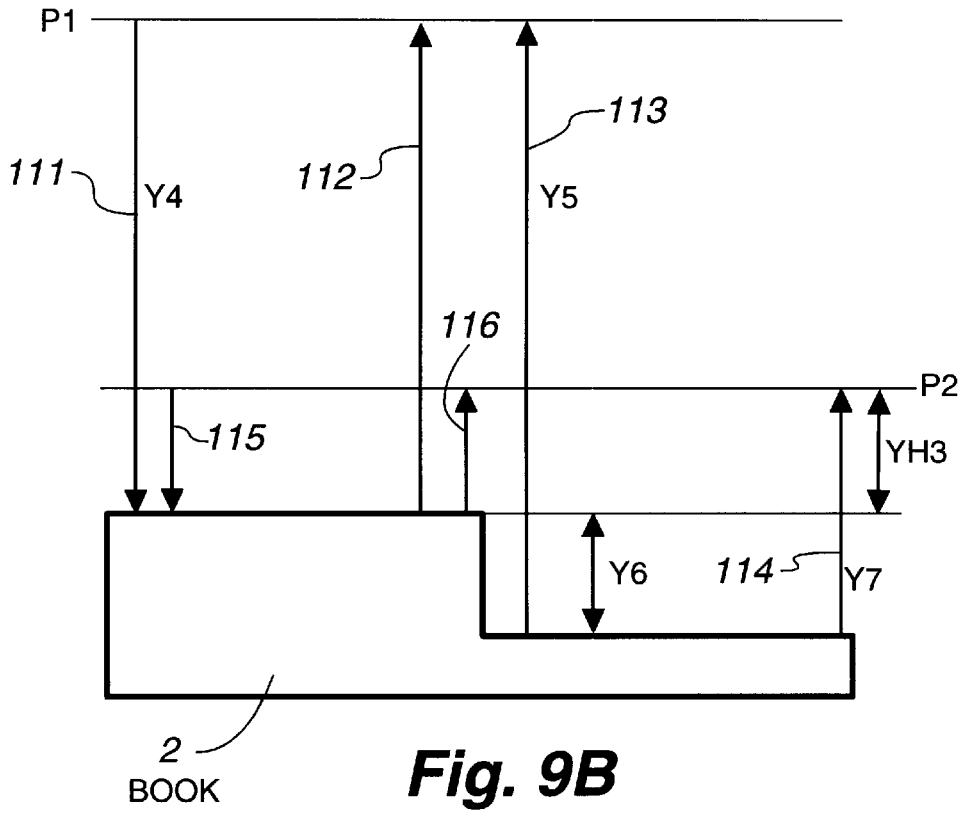

The selection of the mode in which the lines of one page are continuously printed or the mode in which the lines of the both pages are alternately printed is performed by user selection of a mode switch or button on an operator panel, and the control device senses the selection, and performs the above operation. By using the stepper motor as the driving motor of the driving source 66, the movement of the print head 5 shown in the FIG. 9 can be performed. It is assumed that the mode in which the lines of the both pages are alternately printed is selected. FIG. 9(A) shows the first case in which the height of the left side pages is lower than the height of the right side pages, and FIG. 9(B) shows the second case in which the height of the left side pages is higher than the height of the right side pages. The following operation can be performed by the control device 8 which controls driving source 66, in the manner described with respect to the FIG. 5.

With regard to the first case, print head 5 is moved downwardly from the standby position P1 to the left area of the left side page in the direction 101, and lands on the left side page. During the movement in the direction 101, the control device 8 counts the number of rotating counts of the stepper motor to detect the downward distance Y1. The number of rotating counts corresponding to the distance Y1 can be detected by counting the counts or steps from the status of the FIG. 5(A) to the status of the FIG. 5(C). The print operation of one line is performed, and the print head 5 reaches to the right area of the left side page, then the print head 5 is raised to the standby position P1 in the direction 102.

As shown in FIG. 9(A), print head 5 is next moved to the left area of the right side page, and is moved downwardly from the standby position P1 to the right side page in the direction 103. During this downward movement, the control device 8 counts the number of rotating counts of the stepper motor to determine the descending distance Y2. The control device 8 compares the distance Y1 for the left side page and the distance Y2 for the right side page, and detects the relation Y1>Y2, and performs the print of the right side page. In this case, i.e. Y1>Y2, the control device 8 raises the print head 5 now in the right area of the right side page by the distance YH3 along the direction 104 which corresponds to the distance H3.

Next, control device 8 feeds book 2 by one line, and moves the print head 5 horizontally at the height of the position P2 to the left area of the left side page, and moves downwardly the print head 5 to the left side page along the direction 105. During this downward movement 105, the control device 8 counts the number of rotating counts of the stepper motor to determine the descent distance Y3. This distance Y3 is determined by counting the number of the rotating steps from the start of the stepper motor to the status of the FIG. 5(*c*).

Next, the print operation of the new line is performed, and the print head 5 reaches to the right end of the line of the right side page. Control device 8 then moves upwardly the print head upwardly 5 by the distance equal to the descent distance Y3 in the direction 106. The raised position at this time is equal to the position P2 raised by the distance YH3 in the right side page. Control device 8 moves the print head 5 horizontally by keeping the height P2 to the left end of the right side page. Print head 5 is moved downwardly to the page, prints this line, and reaches the right end of this line. Next, the control device 8 moves the print head 5 upwardly by the distance YH3 in the direction 104, and the book 2 is fed by one line, the print head 5 is horizontally moved to the left end of the left side page, and the above operation is repeated.

In this manner, during the print operation of the first line of both the left and right pages, the descent distances Y1 and Y2 from the standby position P1 are detected, and if Y1>Y2, the control device 8 selects the raised position P2 separated by the distance YH3 (corresponding to the distance H3 in FIG. 6) from the surface of the page which generates the lesser distance Y2, as the max. upward position of print head 5 for printing the next lines of both the right and left pages.

With respect to the second case shown in the FIG. 9(B), the print head 5 is moved downwardly from the standby position P1 to the left end of the left side page in the direction 111, and lands on the page. During the movement in the direction 111, the control device 8 counts the number of steps of the stepper motor to determine the distance Y4. The number of steps corresponding to the distance Y4 can be determined by counting the number of steps from the status of the FIG. 5(A) to the status of the FIG. 5(C). Print head 5 prints one line, and reaches the right end of the line. The print head 5 is raised to the standby position P1 in the direction 112. Then, print head 5 is moved to the left end of a line of the right side page, and is moved downwardly from the standby position P1 to the surface of the page in the direction 113.

During this downward movement, control device 8 counts the number of rotating steps of the stepper motor, to determine the distance Y5. Also control device 8 compares the distance Y4 for the left side page and the distance Y5 for the right side page, and detects the relation Y4<Y5. Control device 8 calculates the difference Y6 between Y4 and Y5, (i.e. Y6=Y5−Y4), and prints the line of the right side page. In the case of Y4<Y5, the control device 8 raises the print head 5 at the right end of the right side page by the distance Y6+YH3 in the direction 114.

Next, control device 8 feeds the book 2 by one line, and moves the print head 5 horizontally toward the left end of the left side page by keeping the height P2 (separated by the distance T6+YH3). In the left side page, print head 5 is kept at the height P2 separated by the distance YH3 (which corresponds to the distance H3 in the FIG. 6) from the left side page. Next, control device 8 moves the print head 5 downwardly to the left side page, as indicated by the arrow 115 to print one line, and the print head 5 reaches the right end of the line.

Next, control device 8 raises the print head 5 to the position P2 in the direction 116, and moves print head 5 horizontally to the left end of the right side page by maintaining the height P2. The print head 5 is moved to the line of the page, prints this line, and reaches to the right end of the line of the right side page. Print head 5 is moved upwardly to the position P2 by the distance defined by Y6+YH3=Y7 in the direction 114, the book 2 is fed by one line, the print head 5 is horizontally moved to the left end of the left side page, and the above-described operation is repeated.

In this manner, during the print operation of the first line of both the left and right pages, the distances Y4 and Y5 from the standby position P1 are detected, and if Y4<Y5, the control device 8 selects the raised position P2 separated by the distance YH3 (corresponding to the distance H3 in the FIG. 6) from the surface of the page which generates the lesser distance Y4, as the max. upward position of print head 5 for printing the next lines of both the right and left pages.

By the above-described print operation, the print head 5 in accordance with the present invention does not moved down from the standby position P1 for every print line, as performed in the prior art printer. During the print operation of the second line and the succeeding print operation, the print head 5 of the present invention is reciprocally moved between the surface of the page and the standby position in printing P2, which is separated by the distance YH3 from the surface of the page generating the lesser fall down distance.

Figure 10:
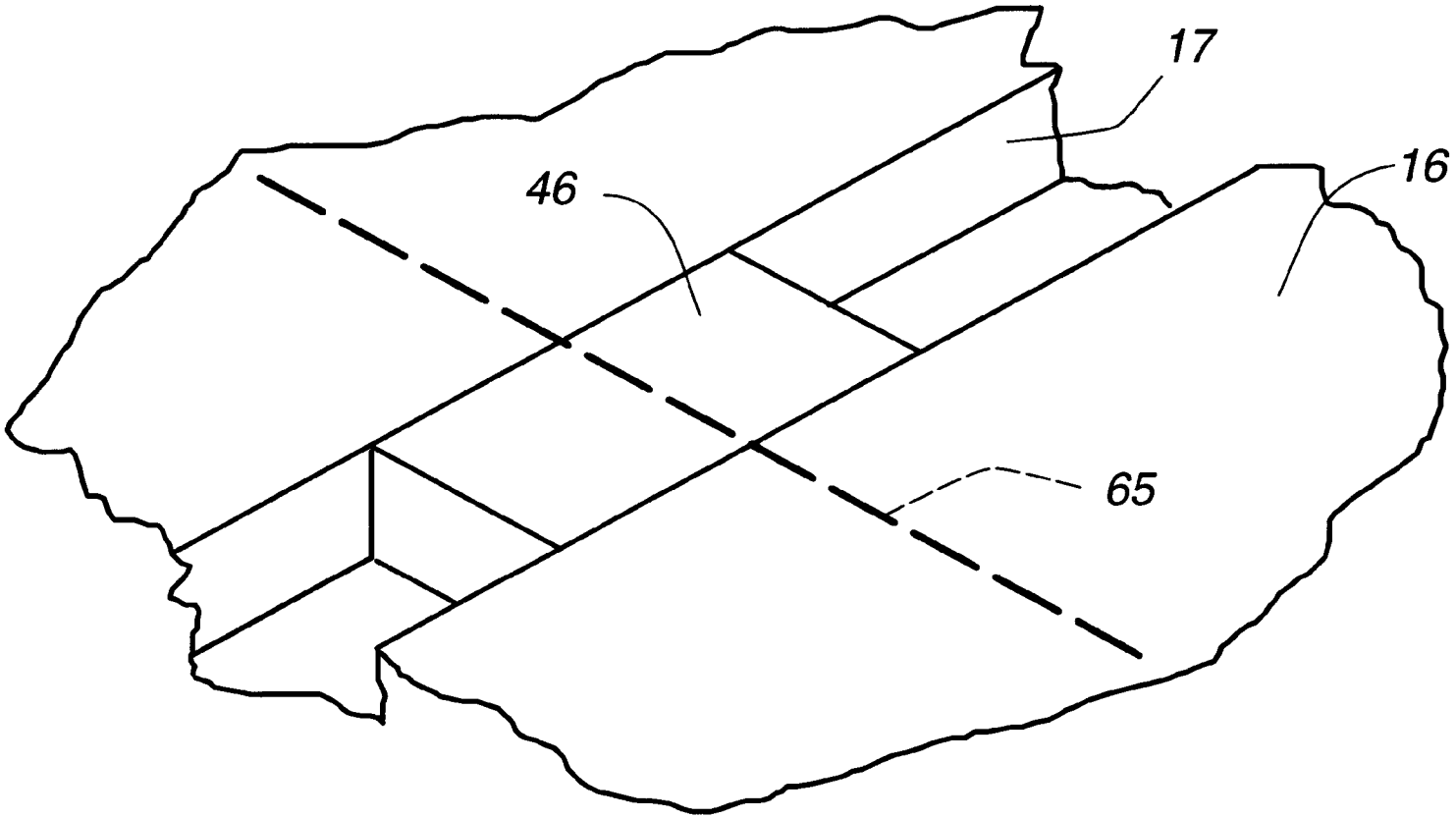
FIG. 10 shows the retractable platen.

Although the printer of the present invention is described to process the book 2, the printer can print a sheet paper with a width over the feeding rollers 31, 32, 26 and 27. To this end, a platen 46 normally kept in its lower, retracted position as illustrated in FIG. 2 is raised to the upper position, as shown in FIG. 10. This print mode is selected by the operator, and the control device 8 responds to the selection to activate a platen moving mechanism, not shown, which moves the platen 46 from the lower position at the bottom of the channel 17 shown in FIG. 2 to the upper position shown in FIG. 10. The movement of the platen may be performed manually. Alternatively the platen movement can be realized by using a mechanism such as cam.

Platen 46 is provided in channel 17 at the position through which the print head 5 moves along the print path 65. When the platen 46 is positioned at the raised position, the surface of the platen 46 is at the same level as the surface of the supporting surface 16, so that when the print head 5 passes the sheet paper on the platen 46, the print wires can print the characters on the paper above plate 46. The print operation on a sheet of paper is substantially the same as that performed for book 2.

One meritorious effect of the invention is that book 2 is fed in the correct feeding direction 24A or 24B without directional skew because each feeding roller 26, 27, 31 and 32 applies the same feeding speed to the book 2. and each feeding roller 26, 27, 31 and 32 is urged to the surface of the book 2 by the same pressing force, in spite of a situation wherein the height of one side pages differs from the height of the other side pages.

In the embodiment shown in FIG. 2, belt 36 is suspended between the pulleys 23 and 35 in the X fashion. Belt 36A is suspended between pulleys 23A and 35A in the X fashion. When the distance between the pulleys 23 and 35 and the pulleys 23A and 35*a* is short, the belts 36 and 36A tend to wear in early stage. To solve this problem, belt 36 may be suspended in an X fashion between the pulley 23 and the pulley 35A, and the belt 36A may be suspended in the X fashion between pulley 23A and the pulley 35.

Description of Reference numbers

1 is the bound portion of the book, 2 is a book, 5 is a print head, 6is a driving motor for rotating the feeding rollers, 7 is a driving source for moving the feeding rollers in the up and down direction, 8 is a control device, 10 is a frame, 13, 13A are supporting shafts, 14 is a first supporting frame, 15 is a second supporting frame, 14A is a third supporting frame, 15*a* is a fourth supporting frame, 16 is a supporting surface, 18, 18A are levers, 17 is a channel, 23, 28, 35, 23A, 28A, 35A, 70, 71, 76 are pulleys, 25, 30, 25A, 30A, 34, 34A are rotating shafts, 26, 27, 31, 32, 37, 38, 39, 40, 26A, 27A,31A, 32A, 37A, 38A, 39A, 40A are feeding rollers, 29, 36, 29A, 36A, 72 are belts, 33, 33A are universal joints, 46 is a platen, 65 is a print line While the exemplary preferred embodiments of the present invention are described herein with particularity, those having normal skill in the art will recognize various changes, modifications, additions, and applications other than those specifically mentioned herein without departing from the spirit of this invention.

What is claimed is:

1. In a printer for printing a book (2) including a plurality of stacked sheets bound at a bound portion (1) in which said book (2) is opened and said opened book (2) is supported on a supporting surface (16) and fed in a feed direction parallel to said bound portion (1), and a left side page and a right side page of said book (2) are printed in a direction which is perpendicular to said feed direction, said printer comprising:

(a) a supporting shaft (13) supported above said supporting surface (16) and extending in parallel relation with said supporting surface;

(b) a channel (17) for receiving said bound portion (1), provided in a middle portion of said supporting surface (16) and extending in a direction which is perpendicular to said supporting shaft (13) thereby dividing said supporting surface (16) into a first area and a second area by said channel (17);

(c) a first supporting frame (14) provided in proximity to said first area and pivotally supported on said supporting shaft (13);

(d) a first rotating shaft (25) rotatably supported by said first supporting frame (14) in parallel with said supporting shaft (13);

(e) a first upper feeding roller (26, 27) fixed on said first rotating shaft (25), and forced to engage said page located on said first area;

(f) a second supporting frame (15) provided in proximity to said second area and pivotally supported on said supporting shaft (13);

(g) a second rotating shaft (30) rotatably supported by said second supporting frame (15) in parallel with said supporting shaft (13);

(h) a second upper feeding roller (31, 32) fixed on said second rotating shaft (30), and forced to engage said page located on said second area;

(i) a universal joint (33) coupling said first rotating shaft (25)and said second rotating shaft (30); and (j) a driving means coupled to one of said first rotating shaft (25) and said second rotating shaft (30) for rotating said first and second rotating shafts (25, 30).

2. A printer according to claim 1, wherein said driving means includes:

a first pulley (28) fixed on said first rotating shaft (25);

a second pulley (23) rotatably supported on said supporting shaft (13); and a first belt (29) for coupling said first pulley (28) and said second pulley (23) for rotating said first pulley (28) and said second pulley (23) in the same direction.

3. A printer according to claim 2, wherein said printer further comprises:

a third rotating shaft (34) rotatably mounted below said supporting surface (16) in parallel with said first rotating shaft (25) and said second rotating shaft (30);

a driving motor (6) for rotating said third rotating shaft (34);

a first lower feeding roller (39, 40) and a second lower feeding roller (37, 38) fixed on said third rotating shaft (34), arranged opposite to said first upper feeding roller (26, 27) and said second upper feeding roller (31, 32), respectively, and engaging with a bottom of said book;

a third pulley (35) fixed on said third rotating shaft (34);

a second belt (36) coupling said third pulley (35) and said second pulley (23) for rotating said third pulley (35) and said second pulley (23) in the same direction, characterized in that a rotating direction of said first upper feeding roller (26, 27) and said second upper feeding roller (31, 32) is opposite to a rotating direction of said first lower feeding roller (39, 40) and said second lower feeding roller (37, 38), and said first and second upper roller (26, 27, 31, 32) whereby said first and second lower feeding roller (39, 40, 37, 38) apply the same feeding force in the same direction to said book.

4. A printer according to claim 3, wherein said printer further comprises:

a first spring (67) biasing said first rotating shaft (25) and said first upper feeding roller (26, 27) toward said first lower feeding roller (39, 40);

a second spring (68) biasing said second rotating shaft (30) and said second upper feeding roller (31, 32) toward said second lower feeding roller (37, 38);

a first member (43) fixed on said supporting shaft (13) for engaging said first supporting frame (14) to raise said frame (14);

a second member (44) fixed on said supporting shaft (13) for engaging said second supporting frame (15) to raise said frame (15); and a rotating means for rotating said supporting shaft (13) to raise said first supporting frame (14) and said second supporting frame (15).

5. A printer according to claim 4, wherein said rotating means comprises:

a lever (18) fixed to said supporting shaft (13); and a first driving means (19, 21) for rotating said lever (18) to rotate said supporting shaft (13).

6. A printer according to claim 5, wherein said first upper feeding roller includes two feeding rollers (26 and 27) for engaging two portions of said page in said first area of said supporting surface (16), and said second upper feeding roller includes two feeding rollers (31 and 32) for engaging two portions of said page in said second area of said supporting surface (16).

7. A printer according to claim 6, said printer further comprising:

a print head (5) movable along a print position (65) adjacent to said first upper feeding roller (26, 27) and said second upper feeding roller (31, 32) in parallel with said supporting shaft (13).

8. A printer according to claim 7, wherein a movable platen (46) is mounted within a portion of said channel (17), which crosses said print position (65), said platen being movable to a lower position until an upper surface of said platen aligns with a bottom surface of said channel (17) when said book is printed; said platen being further movable to a second position wherein said surface of said platen aligns with said supporting surface (16) whereby printing on a sheet of paper is possible despite the presence of said channel (1 7) relative to said supporting surface (16).

9. In a printer for printing a book (2) including a plurality of stacked sheets bound at a bound portion (1) in which said book (2)is opened and said opened book (2) is supported on a supporting surface (16) and fed in a feed direction parallel to said bound portion (1), and a left side page and a right side page of said book (2) are printed in a direction which is perpendicular to said feed direction, said printer comprising:

(a) a first supporting shaft (13) supported above said supporting surface (16) and extended in parallel with said supporting surface;

(b) a channel (17) for receiving said bound portion (1), provided in a middle portion of said supporting surface (16) and extended in a direction which is perpendicular to said first supporting shaft (13), said supporting surface (16) being divided into a first area and second area by said channel (17);

(c) a first supporting frame (14) provided in said first area and pivotally supported on said first supporting shaft (13);

(d) a first rotating shaft (25) rotatably supported by said first supporting frame (14) in parallel with said first supporting shaft (13);

(e) a first upper feeding roller (26, 27) fixed in said first rotating shaft (25), and forced to engage said page when said page is placed on said first area;

(f) a second supporting frame (15) provided in said second area and pivotally supported on said first supporting shaft (13);

(g) a second rotating shaft (30) rotatably supported by said second supporting frame (15) in parallel with said first supporting shaft (13);

(h) a second upper feeding roller (31, 32) fixed on said second rotating shaft (30), and forced to engage said page when said page is placed on said second area;

(i) a first universal joint (33) coupling said first rotating shaft (25) and said second rotating shaft (30);

(j) a second supporting shaft (13A) supported above said supporting surface (16) and extending in parallel with said supporting surface and said first supporting shaft (13);

(k) a third supporting frame (14A) provided in said first area and pivotally supported on said second supporting shaft (13A);

(l) a fourth rotating shaft (25A) rotatably supported by said third supporting frame (14A) in parallel with said second supporting shaft (13A);

(m) a third upper feeding roller (26A, 27A) fixed on said fourth rotating shaft (25A), and forced to said page placed on said first area;

(n) a fourth supporting frame (15A) provided in said second area and pivotally supported on said second supporting shaft (13A);

(o) a fifth rotating shaft (30A) rotatably supported by said fourth supporting frame (15A) in parallel with said second supporting shaft (13A);

(p) a fourth upper feeding roller (31A, 32A) fixed on said fifth rotating shaft (30A), and forced to engage said page when said page is placed on said second area;

(q) a second universal joint (33A) coupling said fourth rotating shaft (25A) and said fifth rotating shaft (30A); and (r) a driving means for rotating said first rotating shaft (25) and said fourth rotating shaft (25A) in the same rotating direction, and characterized in that said first supporting frame (14) and said third supporting frame (14A) are so arranged that said first upper feeding roller (26, 27) of said first supporting frame (14) are adjacent to said third upper feeding roller (26A, 27A) of said third supporting frame (14A), and said second supporting frame (15) and said fourth supporting frame (15A) are so arranged that said second upper feeding roller (31, 32) of said second supporting frame (15) are adjacent to said fourth upper feeding roller (31A, 32A) of said fourth supporting frame (15A).

10. A printer according to claim 9, wherein said driving means includes:

a first pulley (28) fixed on said first rotating shaft (25);

a second pulley (23) rotatably supported on said first supporting shaft (13);

a first belt (29) for coupling said first pulley (28) and said second pulley (23) for rotating said first pulley (28) and said second pulley (23) in the same direction;

a fourth pulley (28A) fixed on said fourth rotating shaft (25A);

a fifth pulley (23A) rotatably supported on said second supporting shaft (13A);

a third belt (29A) for coupling said fourth pulley (28A) and said fifth pulley (23A) for rotating said fourth pulley (28A) and said fifth pulley (23A) in the same direction; and a rotating means (35, 36, 35A, 36A, 72, 76) for rotating said second pulley (23) and said fifth pulley (23A) in the same direction.

11. A printer according to claim 10, said printer further comprising:

a third rotating shaft (34) rotatably mounted below said supporting surface (16) in parallel with said first rotating shaft (25) and said second rotating shaft (30);

a first lower feeding roller (39, 40) and a second lower feeding roller (37, 38) fixed on said third rotating shaft (34), arranged opposite said first upper feeding roller (26, 27) and said second upper feeding roller (31, 32), respectively, and engaging with a bottom of said book;

a third pulley (35, 70) fixed on said third rotating shaft (34);

a second belt (36) coupling said third pulley (35) and said second pulley (23) for rotating said third pulley (35) and said second pulley (23) in the same direction;

a sixth rotating shaft (34A) rotatably mounted below said supporting surface (16) in parallel with said fourth rotating shaft (25A) and said fifth rotating shaft (30A);

a third lower feeding roller (39A, 40A) and a fourth lower feeding roller (37A, 38A) fixed on said sixth rotating shaft (34A), arranged opposite said third upper feeding roller (26A, 27A) and said fourth upper feeding roller (31A, 32A), respectively, and engaging with a bottom of said book;

a sixth pulley (35A, 71) fixed on said sixth rotating shaft (34A);

a fourth belt (36A) coupling said sixth pulley (35A, 71) and said fifth pulley (23A) for rotating said sixth pulley (35A, 71) and said fifth pulley (23A) in the same direction; and a rotating means (6, 72, 74) for rotating said third pulley (35, 70) and said sixth pulley (35A, 71) in the same direction, characterized in that a rotating direction of said first upper feeding roller (26, 27), said second upper feeding roller (31, 32), said third upper feeding roller (**26A, 27*a*) and said fourth upper feeding roller (31A, 21A) is opposite to a rotating direction of said first lower feeding roller (39, 40) and said second lower feeding roller (37, 38), whereby said third lower feeding roller (39A, 40A) and said fourth lower feeding roller (37A, 38A**); and all the feeding rollers apply the same feeding force to said book.

12. A printer according to claim 11, said printer further comprising:

a first spring (67) biasing said first rotating shaft (25) and said first upper feeding roller (26, 27) to said first lower feeding roller (39, 40);

a second spring (68) biasing said second rotating shaft (30) and said second upper feeding roller (31, 32) to said second lower feeding roller (37, 38);

a first member (43) fixed on said first supporting shaft (13) for engaging with said first supporting frame (14) to raise said frame (14);

a second member (44) fixed on said first supporting shaft (13) for engaging with said second supporting frame (15) to raise said frame (15);

a third spring (67A) biasing said fourth rotating shaft (25A) and said third upper feeding roller (26A, 27A) to said third lower feeding roller (39A, 40A);

a fourth spring (68A) biasing said fifth rotating shaft (30A) and said fourth upper feeding roller (31A, 32A) to said fourth lower feeding roller (37A, 38A);

a third member (43A) fixed on said second supporting shaft (13A) for engaging with said third supporting frame (14A) to raise said frame (14A)); a fourth member (44A) fixed on said second supporting shaft (13A) for engaging with said fourth supporting frame (15A) to raise said frame (15A);

a first lever (18) fixed on said first supporting shaft (13);

a second lever (18A) fixed on said second supporting shaft (13A), and a link (73) for coupling said first lever (18) and said second lever (18A);

characterized in that when said first upper feeding roller (26, 27) and said second upper feeding roller (31, 32) contact with said first lower feeding roller (39, 40) and said second lower feeding roller (37, 38), respectively, said third upper feeding roller (26A, 27A) and said fourth upper feeding roller (31A, 32A) are separated from said third lower feeding roller (39A, 40A) and said fourth lower feeding roller (37A, 38A), respectively.

13. A printer according to claim 12, wherein:

said first upper feeding roller includes two feeding rollers (26 and 27) for engaging two portions of said page in said first area of said supporting surface (16), and said second upper feeding roller includes two feeding rollers (31 and 32) for engaging two portions of said page in said second area of said supporting surface (16); and said third upper feeding roller includes two feeding rollers (26A and 27A) for engaging two portions of said page in said first area of said supporting surface (16), and said fourth upper feeding roller includes two feeding rollers (31A and 32A) for engaging two portions of said page in said second area of said supporting surface (16).

14. A printer according to claim 13, said printer further comprising:

a print head (5) moved along a print position (65) in parallel with said first supporting shaft (13) and said second supporting shaft (13A);

said print position (65) being located in an area of said supporting surface (16) between said first and second upper feeding roller (26, 27,31, 32) and said third and fourth upper feeding roller (26A, 27A, 31A, 32A).

15. A printer according to claim 14, which further includes:

a movable platen (46) mounted within a portion of said channel (17), which crosses said print position (65), said platen being moveable to a lower position until an upper surface of said platen aligns with a bottom surface of said channel (17) when said book is printed; said platen being further moveable to a top position until said surface of said platen aligns with said supporting surface (16) when a sheet paper is printed.

16. A method of moving a book (2) in a manner suitable for printing on the upward-facing pages of said book when said book is open, said book being composed of a plurality of stacked sheets that are bound together at a binding-edge (1), said book being openable so as to form a first stack of sheets on a right-side of said binding-edge and a second stack of sheets on a left-side of said binding-edge, and so as to expose an upward-facing right-side page and an upward-facing left-side page of said book, the method comprising the steps of:

supporting said book in an open position relative to a generally flat plane, so that the sheets thereof are generally flat, thereby establishing first and second sheet areas that are defined by the exposed upper surface of a right-side page and the exposed upper surface of a left-side page of said book;

accommodating said binding-edge below the surface defined by said supported open book;

providing first and second driven rollers (26,31) that are independently pivotally mounted for movement in a downward direction generally perpendicular to said first and second sheet areas for independently engaging the respective upper surface of a right-side page and a left-side page of said book regardless of differences in the vertical height of said first and second stacks of said sheets; and applying a force in cooperation with said first and second driven rollers wherein said force is applied with a common magnitude and direction relative to said first and second sheet areas for moving said book in said plane in a direction substantially parallel to said binding-edge.

17. The method of claim 16 which includes the step of;

positioning a print head (5) in vertically spaced proximity to at least one of said sheet areas in accordance with the vertical height of a stack of sheets that is under said print head, for printing on the upper surface of the top sheet of the stack of sheet that is under said print head.

18. A method of moving a book (2) in a manner suitable for printing on the pages of said book wherein said book is composed of a plurality of stacked pages bound at a binding portion (1) and openable so as to expose a left side page and a right side page of said book, comprising the steps of:

supporting said book in an opened position relative to a generally flat plane so that the pages thereof are generally flat thereby defining first and second areas by the exposed uppermost pages of said book;

accommodating said binding portion below the surface defined by said supported open book;

providing pivotally mounted first and second rollers (26, 31) for movement in a direction perpendicular to said first and second areas for independently engaging the surface of respective said first and second areas regardless of differences in height of the stacks of said pages on opposite sides of said binding portion;

applying a force in cooperation with said first and second rollers wherein said force is applied with a common magnitude and direction relative to said first and second areas for moving said book in said plane in a direction substantially parallel to said binding portion;

positioning a print head (5) in proximity to at least one of said first and second areas in accordance with the height of the stack of said pages under said print head;

providing pivotally mounted third and fourth rollers (26A,3 IA) for movement in a direction perpendicular to said first and second areas for independently engaging the surface of respective said first an second areas regardless of differences in height of the stacks of said pages on opposite sides of said binding portion; and providing a coupling between said third and fourth rollers and said print head for controlling the spacing between the uppermost page of a said stack under said print head.

19. The method in accordance with claim 18 which includes the step of moving said print head (5) for printing lines of characters perpendicular to said binding portion (1) of said book (2).

20. The method in accordance with claim 18 which includes the step of moving a platen (46) between a first position forming a continuous surface across said plane of said book supporting step and a second position displaced from said plane of said book supporting step for enabling said accommodating step.

* * * * *